US006306566B2

(12) United States Patent
Sakurada et al.

(10) Patent No.: US 6,306,566 B2
(45) **Date of Patent: *Oct. 23, 2001**

(54) HEAT DEVELOPMENT IMAGE FORMING PROCESS THERMALLY DECOLORING IMAGE RECORDING PROCESS AND PROCESS FOR DECOLORING CYANINE DYE

(75) Inventors: Masami Sakurada; Masaki Noro; Itsuo Fujiwara; Yoshiharu Yabuki, all of Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/175,952

(22) Filed: Oct. 21, 1998

(30) Foreign Application Priority Data

Oct. 21, 1997 (JP) ..... 9-306403

(51) Int. Cl.[7] ..... G03C 1/494; G03C 1/12; G03C 1/14; G03C 1/18; G03C 1/20

(52) U.S. Cl. ..... 430/351; 430/503; 430/576; 430/581; 430/583; 430/584; 430/585; 430/617

(58) Field of Search ..... 430/503, 576, 430/581, 583, 584, 585, 617–620, 351

(56) References Cited

U.S. PATENT DOCUMENTS 4,524,128 6/1985 Edwards et al. .
5,258,282 * 11/1993 Kagami et al. ..... 430/619
5,437,972 * 8/1995 Ikigawa et al. ..... 430/574
5,985,537 * 11/1999 Philip, Jr. et al. ..... 430/619

* cited by examiner

*Primary Examiner*—Janet Baxter
*Assistant Examiner*—Amanda C. Walke
(74) *Attorney, Agent, or Firm*—Sughrue, Mion, Zinn, Macpeak & Seas, PLLC

(57) ABSTRACT

A heat developable light-sensitive material comprises a support, a light-sensitive layer and a non-light-sensitive layer. The light-sensitive layer contains silver halide and a reducing agent. The non-light-sensitive layer contains a cyanine dye represented by the formula (I) or a salt thereof and a base precursor:

(I)

in which $R^1$ is hydrogen, an aliphatic group, an aromatic group, $—NR^{21}R^{24}$, $—OR^{21}$ or $—SR^{21}$, each of $R^{21}$ and $R^{24}$ independently is hydrogen, an aliphatic group or an aromatic group, or $R^{21}$ and $R^{24}$ are combined to form a nitrogen-containing heterocyclic ring; $R^2$ is hydrogen, an aliphatic group or an aromatic group; $R^3$ is an aliphatic group; $L^1$ is a methine chain consisting of an odd number of methines; and each of $Z^1$ and $Z^2$ independently is an atomic group forming a five-membered or six-membered nitrogen-containing heterocyclic ring. A heat development image forming process, a thermal image recording material, a thermally decoloring image recording process and a process for decoloring a cyanine dye are also disclosed.

16 Claims, No Drawings

HEAT DEVELOPMENT IMAGE FORMING PROCESS THERMALLY DECOLORING IMAGE RECORDING PROCESS AND PROCESS FOR DECOLORING CYANINE DYE

FIELD OF THE INVENTION

The present invention relates to a heat developable light-sensitive material, a heat development image forming process, a thermal image recording material, a thermally decoloring image recording process and a process for decoloring cyanine dye.

BACKGROUND OF THE INVENTION

A heat developable light-sensitive material (or a photothermographic material) has already been proposed, and is described in U.S. Pat. Nos. 3,152,904, 3,457,075, and B. Shely "Thermally Processed Silver Systems" (Imaging Processes and Materials, Neblette eighth edition, edited by Sturge, V. Walworth and A. Shepp, page 2, 1996).

The heat developable light-sensitive material generally has a light-sensitive layer, which contains a catalytically active amount of a photo catalyst (e.g., silver halide), a reducing agent, a reducible silver salt (e.g., organic silver salt) and a color toning agent dispersed in a binder matrix. The color toning agent has a function of controlling color tone of silver. A heat development image forming process comprises steps of imagewise exposing to light the heat developable light-sensitive material, and then heating the light-sensitive material at an elevated temperature (not lower than 80° C.) to cause an oxidation-reduction reaction between the silver halide or the reducible silver salt (which functions as an oxidizing agent) and the reducing agent. Thus a black silver image is formed. The oxidation-reduction reaction is accelerated by a catalytic function of a silver halide latent image formed at the exposing step. Accordingly, the black silver image is formed within the exposed area.

The heat development does not require processing solutions of a wet development. The heat development can easily and rapidly be conducted, compared with the wet development. However, the wet development is still a major photographic technology, while the heat development is minor. The heat development has unsolved problems, while the wet development does not have the problems.

A photographic material usually contains a dye, such as a filter dye, an antihalation dye or an antiirradiation dye. The dye functions at the exposing step. If the dye remains in the photographic material after image formation, a formed image would be colored with the dye. Therefore, the dye should be removed from a photographic material at a developing step. At the wet development, the dye can easily be removed from a photographic material by using processing solutions. On the other hand, it is very difficult (substantially impossible) to remove the dye from a photographic material at the heat development.

A simple, easy and rapid development has been desired in the field of recent photography, especially in the field of recent clinical or printing photography. The improvement of the conventional wet development, however, has nearly reached its limits. Therefore, much attention has been paid again to a heat development image forming process in the field of clinical or printing photography.

Since it is very difficult to remove a dye at the heat development, it has been proposed to decolor the dye at the heat development. For example, U.S. Pat. No. 5,135,842 discloses a method of decoloring a polymethine dye of a specific structure by heating a photographic material. U.S. Pat. Nos. 5,314,795, 5,324,627 and 5,384,237 disclose a method of decoloring a polymethine dye by heating a photographic material in the presence of a carbanion forming agent (nucleophilic agent).

SUMMARY OF THE INVENTION

The known process of decoloring a dye by heat has some problems. For example, some dyes are not sufficiently decolored at heat development. Other dyes are decolored while storing a heat developable light-sensitive material because the dyes are not stable. Further, some known dyes are decolored to form decomposition products that have light absorption. Therefore, a formed image (particularly highlighted area) is colored with the decomposition products. Furthermore, some decolored dyes are colored again after the heat development (particularly in the presence of an acid). Moreover, a process of decoloring a dye with another compound such as a nucleophilic agent is influenced with a (stoichiometrical or dimensional) relation between the dye and the agent. Accordingly, the decoloring reaction between the dye and the agent is relatively slow.

An object of the present invention is to provide a heat developable light-sensitive material containing a dye that is free from the above-mentioned problems.

Another object of the invention is to provide a heat development image forming method that can form a clear image in which the dye is completely decolored.

A further object of the invention is to provide a new thermal image recording material.

A furthermore object of the invention is to provide a thermally decoloring image forming process that forms a decolored image in a simple manner.

A still further object of the invention is to provide a process of decoloring a dye that is stable at room temperature by a substantially irreversible quick reaction.

The present invention provides a heat developable light-sensitive material comprising a support, a light-sensitive layer and a non-light-sensitive layer, said light-sensitive layer containing silver halide and a reducing agent, and said non-light-sensitive layer containing a cyanine dye represented by the formula (I) or a salt thereof and a base precursor:

(I)

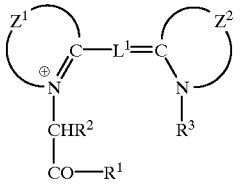

in which $R^1$ is hydrogen, an aliphatic group, an aromatic group, $—NR^{21}R^{24}$, $—OR^{21}$ or $—SR^{21}$, each of $R^{21}$ and $R^{24}$ independently is hydrogen, an aliphatic group or an aromatic group, or $R^{21}$ and $R^{24}$ are combined to form a nitrogen-containing heterocyclic ring; $R^2$ is hydrogen, an aliphatic group or an aromatic group; $R^3$ is an aliphatic group; $L^1$ is a methine chain consisting of an odd number of methines; and each of $Z^1$ and $Z^2$ independently is an atomic group forming a five-membered or six-membered nitrogen-containing heterocyclic ring, which may be condensed with an aromatic ring.

The invention also provides a heat development image forming process comprising steps of:

imagewise exposing to light a heat developable light-sensitive material comprising a support, a light-sensitive layer and a non-light-sensitive layer, said light-sensitive layer containing silver halide and a reducing agent, and said non-light-sensitive layer containing a cyanine dye represented by the formula (I) or a salt thereof and a base precursor: and then heating the heat developable light-sensitive material at 80 to 200° C. to form a base from the base precursor whereby the cyanine dye is decolored and to develop the silver halide.

The invention further provides a thermal image recording material comprising a support and an image recording layer, said image recording layer containing a cyanine dye represented by the formula (I) or a salt thereof and a base precursor.

The invention furthermore provides a thermally decoloring image recording process comprising imagewise heating a thermal image recording material at 80 to 200° C., said image recording material comprising a support and an image recording layer, said image recording layer containing a cyanine dye represented by the formula (I) or a salt thereof and a base precursor to form a base from the base precursor whereby the cyanine dye is decolored.

The invention still further provides a process for decoloring a cyanine dye comprising heating a cyanine dye represented by the formula (II) or a salt thereof at 80 to 200° C. in the presence of a base:

(II)

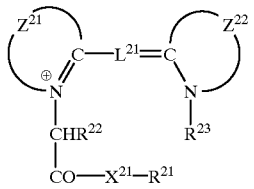

in which $X^{21}$ is —$NR^{24}$—, —O— or —S—; each of $R^{21}$ and $R^{24}$ independently is hydrogen, an aliphatic group or an aromatic group, or $R^{21}$ and $R^{24}$ are combined to form a nitrogen-containing heterocyclic ring; $R^{22}$ is hydrogen, an aliphatic group or an aromatic group; $R^{23}$ is an aliphatic group; $L^{21}$ is a methine chain consisting of an odd number of methines; and each of $Z^{21}$ and $Z^{22}$ independently is an atomic group forming a five-membered or six-membered nitrogen-containing heterocyclic ring, which may be condensed with an aromatic ring.

The present inventors have found that the cyanine dye represented by the formula (I) is advantageously added to a non-light-sensitive layer of a heat developable light-sensitive material. The cyanine dye represented by the formula (I) is quickly decolored by a substantially irreversible reaction at heat development in an image forming method. According to study of the present inventors, a substantially colorless compound is formed from the cyanine dye represented by the formula (I) by an intramolecular ring forming reaction when the dye is heated in the presence of a base (under a basic condition). The reaction rapidly proceeds without influence caused by another agent because the decoloring reaction is an intramolecular reaction. Further, the decoloring reaction is a ring forming reaction that forms a five-membered or seven-membered ring condensed with the basic nucleus (onium form) of the cyanine dye. The formed compound is substantially colorless and relatively stable. Accordingly, the decoloring reaction is substantially irreversible. For the reasons mentioned above, the heat developable light-sensitive material of the present invention can form a clear image in which the dye is completely decolored.

Further, a thermal image recording material can be prepared by using the cyanine dye represented by the formula (I). A thermally decolored image can be easily formed by a simple step of imagewise heating the thermal image recording material.

Furthermore, the cyanine dye represented by the formula (II) is a stable compound at room temperature. According to the process of decoloring a dye, the stable dye can be decolored by a substantially irreversible quick reaction.

DETAILED DESCRIPTION OF THE INVENTION

The present invention uses a cyanine dye represented by the formula (I) or a salt thereof.

(I)

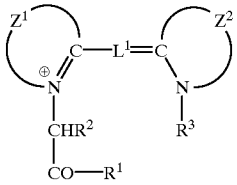

In the formula (I), $R^1$ is hydrogen, an aliphatic group, an aromatic group, —$NR^{21}R^{24}$, —$OR^{21}$ or —$SR^{21}$. Each of $R^{21}$ and $R^{24}$ independently is hydrogen, an aliphatic group or an aromatic group, or $R^{21}$ and $R^{24}$ are combined to form a nitrogen-containing heterocyclic ring. $R^1$ preferably is —$NR^{21}R^{24}$, —$OR^{21}$ or —$SR^{21}$, as is defined in the formula (II). The details of —$NR^{21}R^{24}$, —$OR^{21}$ and —$SR^{21}$ are described about the formula (II).

In the present specification, the aliphatic group means an alkyl group, a substituted alkyl group, an alkenyl group, a substituted alkenyl group, an alkynyl group, a substituted alkynyl group, an aralkyl group and a substituted aralkyl group. The alkyl group, the substituted alkyl group, the alkenyl group, the substituted alkenyl group, the aralkyl group and the substituted aralkyl group are preferred, and the alkyl group, the substituted alkyl group, the aralkyl group and the substituted aralkyl group are more preferred. The aliphatic group preferably has a chain structure rather than a cyclic structure. The aliphatic group of the chain structure may be branched.

The alkyl group preferably has 1 to 30 carbon atoms, more preferably has 1 to 20 carbon atoms, further preferably has 1 to 15 carbon atoms, and most preferably has 1 to 12 carbon atoms. The alkyl moiety of the substituted alkyl group is the same as the above-described alkyl group.

The alkenyl group and the alkynyl group preferably has 2 to 30 carbon atoms, more preferably has 2 to 20 carbon atoms, further preferably has 2 to 15 carbon atoms, and most preferably has 2 to 12 carbon atoms. The alkenyl moiety of the substituted alkenyl group and the alkynyl moiety of the substituted alkynyl group are the same as the above-described alkenyl group and alkynyl group respectively.

The aralkyl group preferably has 7 to 35 carbon atoms, more preferably has 7 to 25 carbon atoms, further preferably has 7 to 20 carbon atoms, and most preferably has 7 to 15 carbon atoms. The aralkyl moiety of the substituted aralkyl group is the same as the above-described aralkyl group.

Examples of the substituent groups of the aliphatic groups (the substituted alkyl group, the substituted alkenyl group, the substituted alkynyl group and the substituted aralkyl group) include a halogen atom (fluorine, chlorine, bromine), hydroxyl, nitro, carboxyl, sulfo, an acyl group, an alkoxy group, an alkoxycarbonyl group, an alkylthio group, an alkylthiocarbonyl group, an aryloxy group, an aryloxycarbonyl group and a carbamoyl group. Carboxyl and sulfo can be in the form of a salt. The cation forming a salt with carboxyl or sulfo preferably is an alkali metal ion (e.g., sodium ion, potassium ion).

In the present specification, the aromatic group means an aryl group and a substituted aryl group.

The aryl group preferably has 6 to 30 carbon atom, more preferably has 6 to 20 carbon atoms, further preferably has 6 to 15 carbon atoms, and most preferably has 6 to 12 carbon atoms. The aryl moiety of the substituted aryl group is the same as the above-described aryl group.

Examples of the substituent groups of the aromatic group (the substituted aryl group) include a halogen atom (fluorine, chlorine, bromine), hydroxyl, nitro, carboxyl, sulfo, an alkyl group, an acyl group, an alkoxy group, an alkoxycarbonyl group, an alkylthio group, an alkylthiocarbonyl group, an aryloxy group, an aryloxycarbonyl group and a carbamoyl group. Carboxyl and sulfo can be in the form of a salt. The cation forming a salt with carboxyl or sulfo preferably is an alkali metal ion (e.g., sodium ion, potassium ion).

In the formula (I), $R^2$ is hydrogen, an aliphatic group or an aromatic group. The aliphatic group and the aromatic group are defined above. $R^2$ preferably is hydrogen or an aliphatic group, more preferably is hydrogen or an alkyl group, further preferably is hydrogen or an alkyl group having 1 to 15 carbon atoms, and most preferably is hydrogen.

In the formula (I), $R^3$ is an aliphatic group. The aliphatic group is defined above. $R^3$ preferably is a substituted alkyl group. In view of synthesis of the compound, $R^3$ preferably is a substituted alkyl group having the same meanings as $—CHR^2—CO—R^1$.

In the formula (I), $L^1$ is a methine chain consisting of an odd number of methines. The number of the methines preferably is 3, 5, 7 or 9, more preferably is 3, 5 or 7, further preferably is 5 or 7, and most preferably is 5.

The methine may have a substituent group. Examples of the substituent groups include a halogen atom, an aliphatic group, an aromatic group, $—NR^5R^6$, $—OR^5$ and $—SR^5$. Each of $R^5$ and $R^6$ independently is hydrogen, an aliphatic group or an aromatic group. The aliphatic group and the aromatic group are defined above. The substituent groups of the methine can be combined to form an unsaturated aliphatic ring or an unsaturated heterocyclic ring. The unsaturated aliphatic ring is preferred to the unsaturated heterocyclic ring. The formed ring preferably is a five-membered or six-membered ring. Cyclohexene ring is particularly preferred. The methine chain preferably is not substituted, or forms cyclohexene ring by combining substituent groups.

In the formula (I), each of $Z^1$ and $Z^2$ independently is an atomic group forming a five-membered or six-membered nitrogen-containing heterocyclic ring. Examples of the nitrogen-containing heterocyclic rings include oxazole ring, thiazole ring, selenazole ring, pyrroline ring, imidazole ring and pyridine ring. A six-membered ring is preferred to a five-membered ring. The nitrogen-containing heterocyclic ring may be condensed with an aromatic ring (benzene ring, naphthalene ring). The nitrogen-containing heterocyclic ring and the condensed ring may have a substituent group. Examples of the substituent groups include a halogen atom (fluorine, chlorine, bromine), hydroxyl, nitro, carboxyl, sulfo and an alkyl group. Carboxyl and sulfo can be in the form of a salt. The cation forming a salt with carboxyl or sulfo preferably is an alkali metal ion (e.g., sodium ion, potassium ion).

The cyanine dye represented by the formula (I) is preferably used in the form of a salt, which consists of the dye and an anion. In the case that the cyanine dye represented by the formula (I) has an anionic group such as carboxyl and sulfo, the dye can form an intramolecular salt. In the other cases, the cyanine dye preferably forms a salt with an anion other than its molecule. The anion preferably is monovalent or divalent, and more preferably is monovalent. Examples of the anions include halide ion (Cl, Br, I), p-toluenesulfonate ion, ethylsulfate ion, 1,5-disulfonaphthalene dianion, $PF_6$, $BF_4$ and $ClO_4$.

A preferred cyanine dye is represented by the formula (Ia).

(Ia)

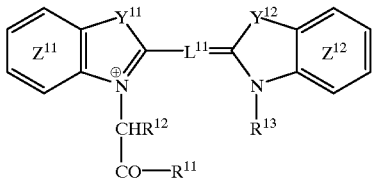

In the formula (Ia), $R^{11}$ is hydrogen, an aliphatic group, an aromatic group, $—NR^{31}R^{34}$, $—OR^{31}$ or $—SR^{31}$. Each of $R^{31}$ and $R^{34}$ independently is hydrogen, an aliphatic group or an aromatic group, or $R^{31}$ and $R^{34}$ are combined to form a nitrogen-containing heterocyclic ring. $R^{11}$ preferably is $—NR^{31}R^{34}$, $—OR^{31}$ or $—SR^{31}$, as is defined in the formula (IIa). The details of $—NR^{31}R^{34}$, $—OR^{31}$ and $—SR^{31}$ are described about the formula (IIa).

In the formula (Ia), $R^{12}$ is hydrogen, an aliphatic group or an aromatic group. $R^{12}$ preferably is hydrogen or an aliphatic group, more preferably is hydrogen or an alkyl group, further preferably is hydrogen or an alkyl group having 1 to 15 carbon atoms, and most preferably is hydrogen.

In the formula (Ia), $R^{13}$ is an aliphatic group. $R^{13}$ preferably is a substituted alkyl group. In view of synthesis of the compound, $R^{13}$ preferably is a substituted alkyl group having the same meanings as $—CHR^{12}—CO—R^{11}$.

In the formula (Ia), $L^{11}$ is a methine chain consisting of an odd number of methines. The number of the methines preferably is 3, 5, 7 or 9, more preferably is 3, 5 or 7, further preferably is 5 or 7, and most preferably is 5.

The methine may have a substituent group. Examples of the substituent groups include a halogen atom, an aliphatic group, an aromatic group, $—NR^{15}R^{16}$, $—OR^{15}$ and $—SR^{15}$. Each of $R^{15}$ and $R^{16}$ independently is hydrogen, an aliphatic group or an aromatic group. The aliphatic group and the aromatic group are defined above. The substituent groups of the methine can be combined to form an unsaturated aliphatic ring or an unsaturated heterocyclic ring. The unsaturated aliphatic ring is preferred to the unsaturated heterocyclic ring. The formed ring preferably is a five-membered or six-membered ring. Cycloheptene ring and cyclohexene ring are particularly preferred. The methine chain preferably is not substituted, or forms cycloheptene ring or cyclohexene ring by combining substituent groups.

In the formula (Ia), each of $y^{11}$ and $y^{12}$ independently is $—CR^{14}R^{15}—$, $—NR^{14}—$, —O—, —S—or —Se—. Each of $R^{14}$ and $R^{15}$ independently is hydrogen or an aliphatic group or $R^{14}$ and $R^{15}$ are combined to form an aliphatic ring. The aliphatic group preferably is an alkyl group or a substituted alkyl group. The aliphatic ring preferably is a saturated aliphatic ring, more preferably is five-membered ring (cyclopentane ring), six-membered ring (cyclohexane ring) or seven-membered ring (cycloheptane ring), and most preferably is cyclohexane ring.

In the formula (Ia), the benzene rings of $Z^{11}$ and $Z^{12}$ may be condensed with another benzene ring. The benzene rings of $Z^{11}$, $Z^{12}$ and the condensed ring may have a substituent group. Examples of the substituent groups include a halogen atom (fluorine, chlorine, bromine), hydroxyl, nitro, carboxyl, sulfo and an alkyl group. Carboxyl and sulfo can be in the form of a salt. The cation forming a salt with carboxyl or sulfo preferably is an alkali metal ion (e.g., sodium ion, potassium ion).

The cyanine dye represented by the formula (Ia) is preferably used in the form of a salt, which consists of the dye and an anion. The salt is described about the formula (I).

A more preferred cyanine dye is represented by the formula (Ib).

(Ib)

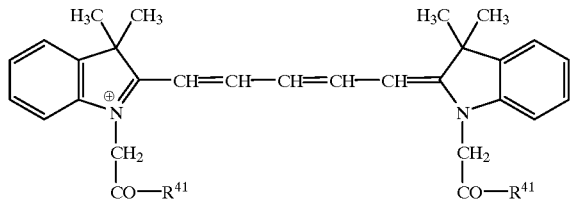

In the formula (Ib), the two groups of $R^{41}$ are identical. $R^{41}$ is hydrogen, an aliphatic group, an aromatic group, $—NR^{51}R^{52}$, $—OR^{51}$ or $—SR^{51}$. Each of $R^{51}$ and $R^{52}$ independently is hydrogen, an aliphatic group or an aromatic group, or $R^{51}$ and $R^{52}$ are combined to form a nitrogen-containing heterocyclic ring. $R^{41}$ preferably is $—NR^{51}R^{52}$, $—OR^{51}$ or $—SR^{51}$, as is defined in the formula (IIa). The details of $—NR^{51}R^{52}$, $—OR^{51}$ and $—SR^{51}$ are described about the formula (IIb).

The cyanine dye represented by the formula (Ib) is preferably used in the form of a salt, which consists of the dye and an anion. The salt is described about the formula (I).

In the formula (I), $R^1$ preferably is $—NR^{21}R^{24}$, $—OR^{21}$ or $—SR^{21}$. Where $R^1$ is hydrogen, an aliphatic group or an aromatic group, the cyanine dye is quickly decolored by a base at an elevated temperature. However, the dye having hydrogen, an aliphatic group or an aromatic group as $R^1$ is sometimes decolored while storing it because the dye is relatively labile. The stability of the dye is improved where $R^1$ is $—NR^{21}R^{24}$, $—OR^{21}$ or $—SR^{21}$. The stable cyanine dye is represented by the formula (II).

(II)

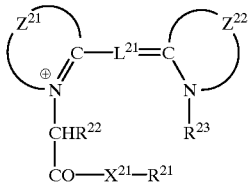

In the formula (II), $X^{21}$ is $—NR^{24}—$, —O— or —S—. Each of $R^{21}$ and $R^{24}$ independently is hydrogen, an aliphatic group or an aromatic group, or $R^{21}$ and $R^{24}$ are combined to form a nitrogen-containing heterocyclic ring. $R^{21}$ preferably is an aliphatic group or an aromatic group, and more preferably is an alkyl group, a substituted alkyl group, an aralkyl group, a substituted aralkyl group, an aryl group or a substituted aryl group. $R^{24}$ preferably is hydrogen or an aliphatic group, and more preferably is hydrogen, an alkyl group or a substituted alkyl group. The nitrogen-containing heterocyclic ring formed by combining $R^{21}$ and $R^{24}$ preferably is a five-membered ring or a six-membered ring. The nitrogen-containing heterocyclic ring may contain a hetero atom (e.g., oxygen, sulfur) in addition to nitrogen.

In the formula (II), $R^{22}$ is hydrogen, an aliphatic group or an aromatic group. $R^{22}$ preferably is hydrogen or an aliphatic group, more preferably is hydrogen or an alkyl group, further preferably is hydrogen or an alkyl group having 1 to 15 carbon atoms, and most preferably is hydrogen.

In the formula (II), $R^{23}$ is an aliphatic group. $R^{23}$ preferably is a substituted alkyl group. In view of synthesis of the compound, $R^{23}$ preferably is a substituted alkyl group having the same meanings as $—CHR^{22}—CO—R^{21}$.

In the formula (II), $L^{21}$ is a methine chain consisting of an odd number of methines. The number of the methines preferably is 3, 5, 7 or 9, more preferably is 3, 5 or 7, further preferably is 5 or 7, and most preferably is 5.

The methine may have a substituent group. Examples of the substituent groups include a halogen atom, an aliphatic group, an aromatic group, $—NR^{25}R^{26}$, $—OR^{25}$ and $—SR^{25}$. Each of $R^{25}$ and $R^{26}$ independently is hydrogen, an aliphatic group or an aromatic group. The aliphatic group and the aromatic group are defined above. The substituent groups of the methine can be combined to form an unsaturated aliphatic ring or an unsaturated heterocyclic ring. The unsaturated aliphatic ring is preferred to the unsaturated heterocyclic ring. The formed ring preferably is a five-membered or six-membered ring. Cycloheptene ring is particularly preferred. The methine chain preferably is not substituted, or forms cyclohexene ring by combining substituent groups.

In the formula (II), each of $Z^{21}$ and $Z^{22}$ independently is an atomic group forming a five-membered or six-membered nitrogen-containing heterocyclic ring. Examples of the nitrogen-containing heterocyclic rings include oxazole ring, thiazole ring, selenazole ring, pyrroline ring, imidazole ring and pyridine ring. A six-membered ring is preferred to a five-membered ring. The nitrogen-containing heterocyclic ring may be condensed with an aromatic ring. The nitrogen-containing heterocyclic ring and the condensed ring may have a substituent group. Examples of the substituent groups include a halogen atom, hydroxyl, nitro, carboxyl, sulfo and an alkyl group. Carboxyl and sulfo can be in the form of a salt. The cation forming a salt with carboxyl or sulfo preferably is an alkali metal ion.

The cyanine dye represented by the formula (II) is preferably used in the form of a salt, which consists of the dye and an anion. The salt is described about the formula (I).

In the formula (Ia), $R^{11}$ preferably is —$NR^{31}R^{34}$, —$OR^{31}$ or —$SR^{31}$. The preferred cyanine dye is represented by the formula (IIa).

(IIa)

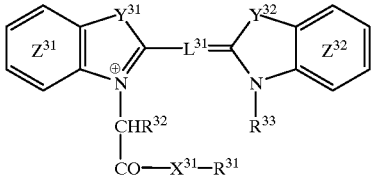

In the formula (IIa), $X^{31}$ is —$NR^{34}$—, —O— or —S—. Each of $R^{31}$ and $R^{34}$ independently is hydrogen, an aliphatic group or an aromatic group, or $R^{31}$ and $R^{34}$ are combined to form a nitrogen-containing heterocyclic ring. $R^{31}$ preferably is an aliphatic group or an aromatic group, and more preferably is an alkyl group, a substituted alkyl group, an aralkyl group, a substituted aralkyl group, an aryl group or a substituted aryl group. $R^{34}$ preferably is hydrogen or an aliphatic group, and more preferably is hydrogen, an alkyl group or a substituted alkyl group. The nitrogen-containing heterocyclic ring formed by combining $R^{31}$ and $R^{34}$ preferably is a five-membered ring or a six-membered ring. The nitrogen-containing heterocyclic ring may contain a hetero atom in addition to nitrogen.

In the formula (IIa), $R^{32}$ is hydrogen, an aliphatic group or an aromatic group. $R^{32}$ preferably is hydrogen or an aliphatic group, more preferably is hydrogen or an alkyl group, further preferably is hydrogen or an alkyl group having 1 to 15 carbon atoms, and most preferably is hydrogen.

In the formula (IIa), $R^{33}$ is an aliphatic group. $R^{33}$ preferably is a substituted alkyl group. In view of synthesis of the compound, $R^{33}$ preferably is a substituted alkyl group having the same meanings as —$CHR^{32}$—CO—$R^{31}$.

In the formula (IIa), $L^{31}$ is a methine chain consisting of an odd number of methines. The number of the methines preferably is 3, 5, 7 or 9, more preferably is 3, 5 or 7, further preferably is 5 or 7, and most preferably is 5.

The methine may have a substituent group. Examples of the substituent groups include a halogen atom, an aliphatic group, an aromatic group, —$NR^{35}R^{36}$, —$OR^{35}$ and —$SR^{35}$. Each of $R^{35}$ and $R^{36}$ independently is hydrogen, an aliphatic group or an aromatic group. The aliphatic group and the aromatic group are defined above. The substituent groups of the methine can be combined to form an unsaturated aliphatic ring or an unsaturated heterocyclic ring. The unsaturated aliphatic ring is preferred to the unsaturated heterocyclic ring. The formed ring preferably is a five-membered or six-membered ring. Cycloheptene ring and cyclohexene ring are particularly preferred. The methine chain preferably is not substituted, or forms cycloheptene ring or cyclohexene ring by combining substituent groups.

In the formula (IIa), $Y^{31}$ and $Y^{32}$ independently is —$CR^{37}R^{38}$—, —$NR^{37}$—, —O—, —S— or —Se—. Each of $R^{37}$ and $R^{38}$ independently is hydrogen or an aliphatic group or $R^{37}$ and $R^{38}$ are combined to form an aliphatic ring. The aliphatic group preferably is an alkyl group or a substituted alkyl group. The aliphatic ring preferably is a saturated aliphatic ring, more preferably is cyclopentane ring, cyclohexane ring or cycloheptane ring, and most preferably is cyclohexane ring.

In the formula (IIa), the benzene rings of $Z^{31}$ and $Z^{32}$ may be condensed with another benzene ring. The benzene rings of $Z^{11}$, $Z^{12}$ and the condensed ring may have a substituent group. Examples of the substituent groups include a halogen atom, hydroxyl, nitro, carboxyl, sulfo and an alkyl group. Carboxyl and sulfo can be in the form of a salt. The cation forming a salt with carboxyl or sulfo preferably is an alkali metal ion.

The cyanine dye represented by the formula (IIa) is preferably used in the form of a salt, which consists of the dye and an anion. The salt is described about the formula (I).

In the formula (IIb), $R^{41}$ preferably is —$NR^{51}R^{52}$, —$OR^{51}$ or —$SR^{51}$. The most preferred cyanine dye is represented by the formula (IIb).

(IIb)

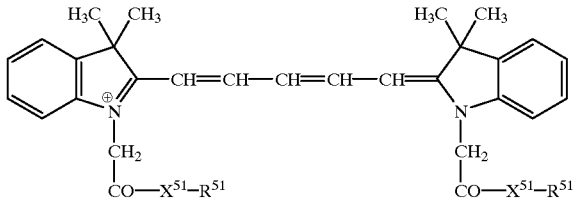

In the formula (IIb), the two groups of $X^{51}$ are identical. The two groups of $R^{51}$ are also identical. $X^{51}$ is —$NR^{52}$—, —O— or —S—. Each of $R^{51}$ and $R^{52}$ independently is hydrogen, an aliphatic group or an aromatic group, or $R^{51}$ and $R^{52}$ are combined to form a nitrogen-containing heterocyclic ring. $R^{51}$ preferably is an aliphatic group or an aromatic group, and more preferably is an alkyl group, a substituted alkyl group, an aralkyl group, a substituted aralkyl group, an aryl group or a substituted aryl group. $R^{52}$ preferably is hydrogen or an aliphatic group, and more preferably is hydrogen, an alkyl group or a substituted alkyl group. The nitrogen-containing heterocyclic ring formed by combining $R^{51}$ and $R^{52}$ preferably is a five-membered ring or a six-membered ring. The nitrogen-containing heterocyclic ring may contain a hetero atom in addition to nitrogen.

The cyanine dye represented by the formula (IIb) is preferably used in the form of a salt, which consists of the dye and an anion. The salt is described about the formula (I).

Examples of the cyanine dyes represented by the formula (Ib) are shown below. The anion (X) and $R^{41}$ of the formula (Ib) are shown in the examples.

(1)

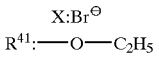

(2)

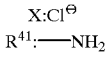

(3)

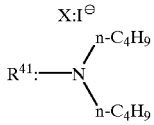

(4)

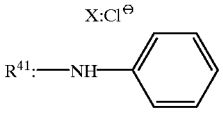

-continued
(5)
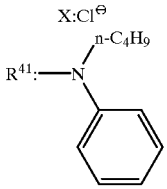
(6)
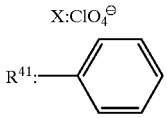
(7)
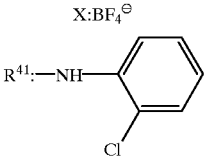
(8)
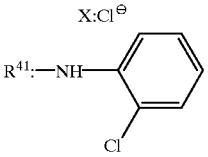
(9)
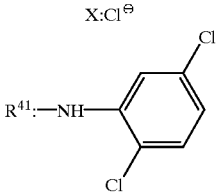
(10)
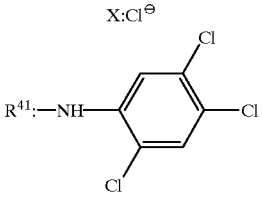
(11)
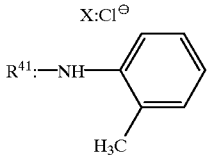
(12)
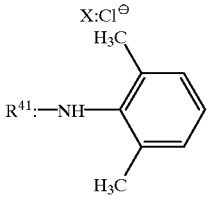
-continued
(13)
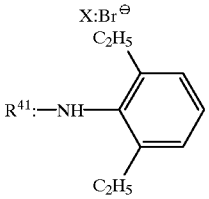
(14)
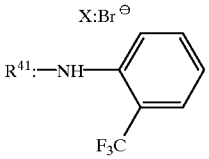
(15)
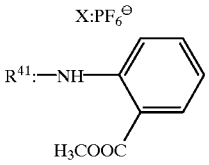
(16)
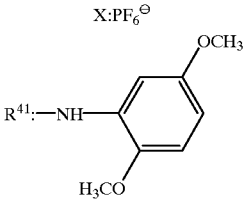
(17)
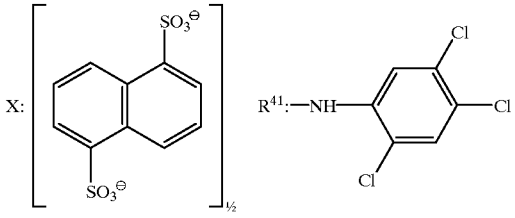
(18)
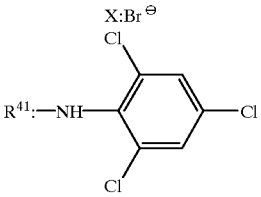
(19)
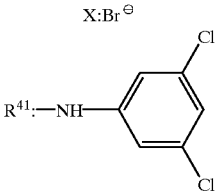

-continued
(20)
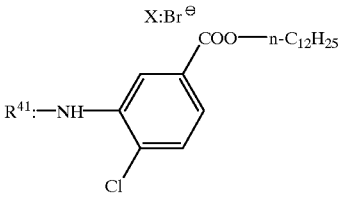
(21)
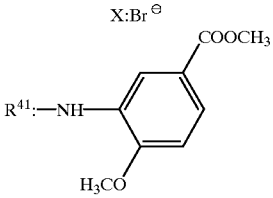
(22)
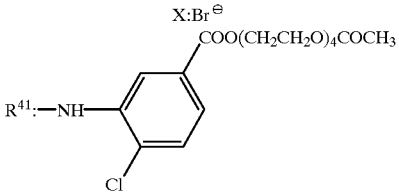
(23)
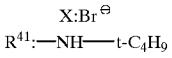
(24)
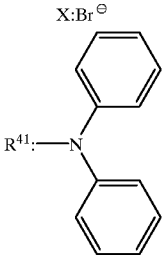
(25)
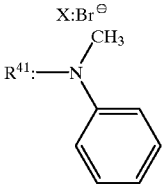
(26)
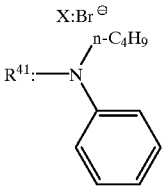
-continued
(27)
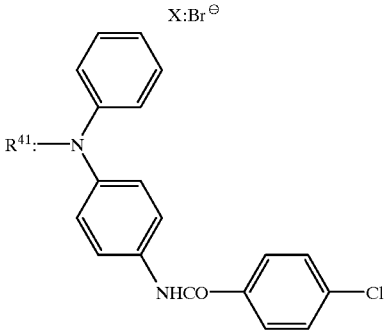
(28)
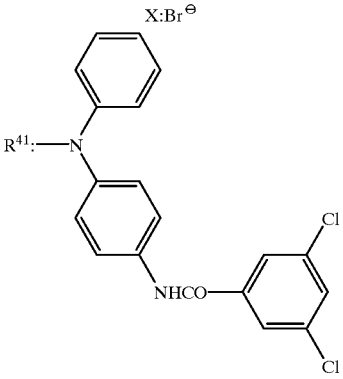
(29)
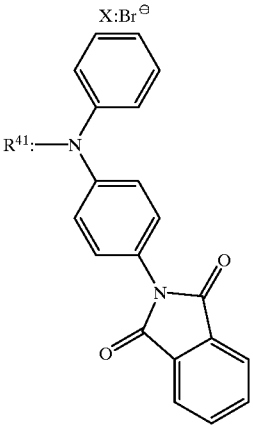
(30)
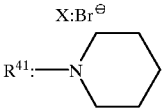
(31)
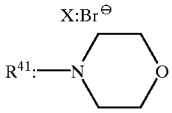

-continued
(32)
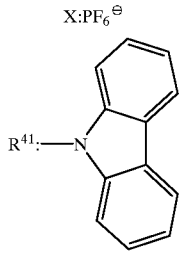
(33)
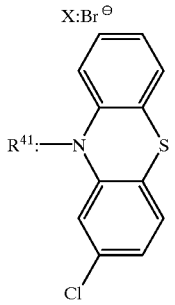
(34)
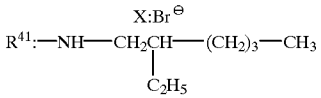
(35)
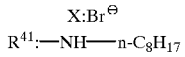
(36)
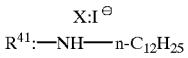
(37)
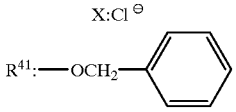
(38)
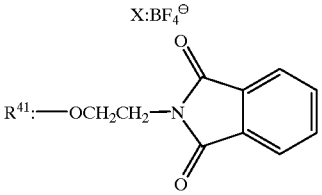
(39)
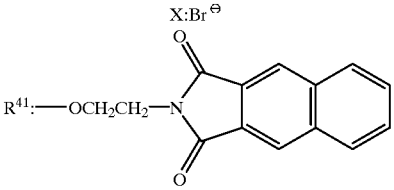
-continued
(40)
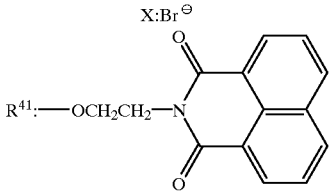
(41)
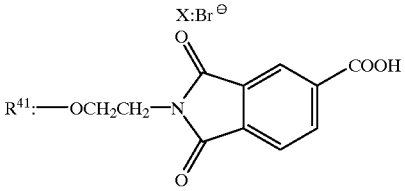
(42)
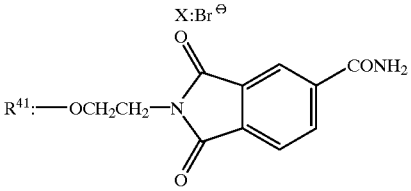
(43)
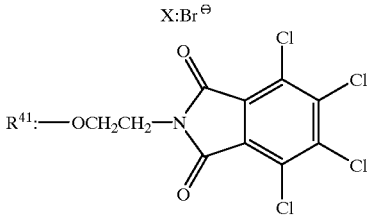
(44)
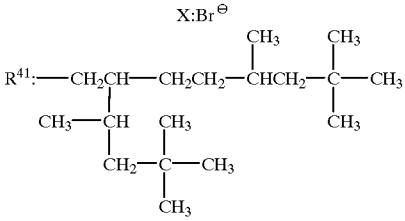
(45)
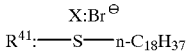
(46)
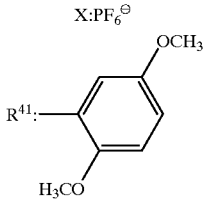
The other cyanine dyes represented by the formula (I) are shown below.

(47)
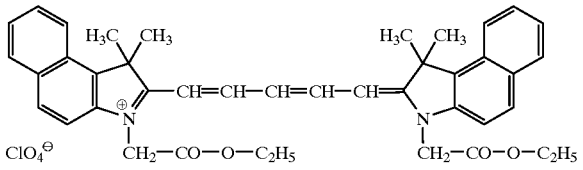
(48)
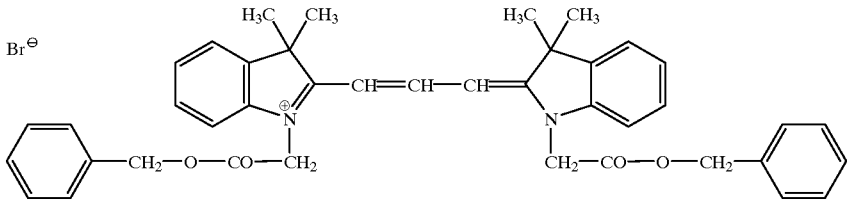
(49)
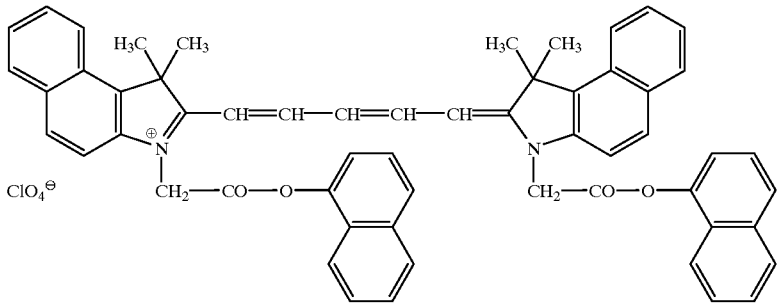
(50)
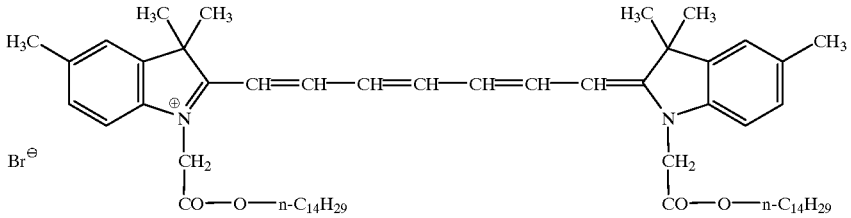
(51)
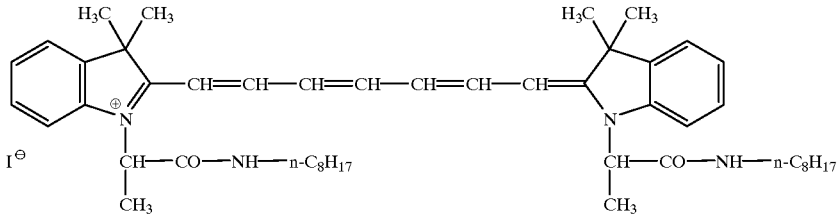
(52)
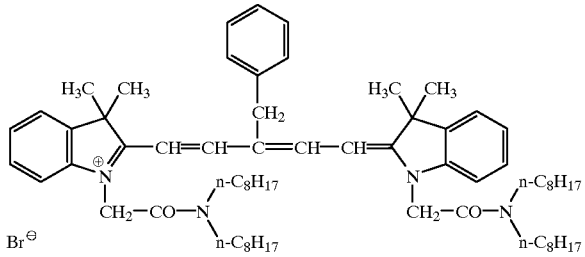
(53)
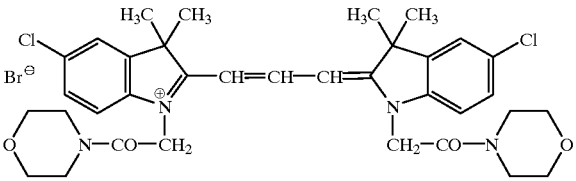

-continued
(54)
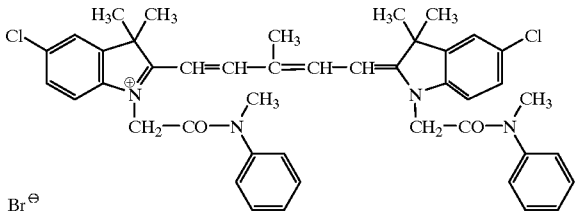
(55)
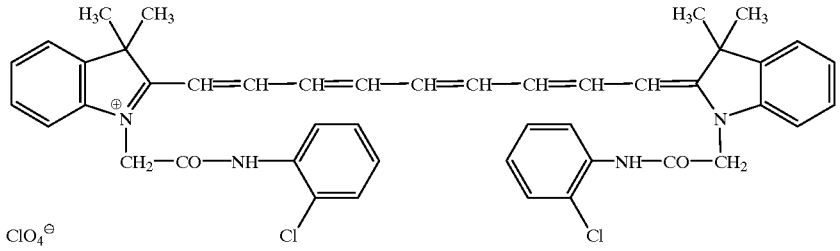
(56)
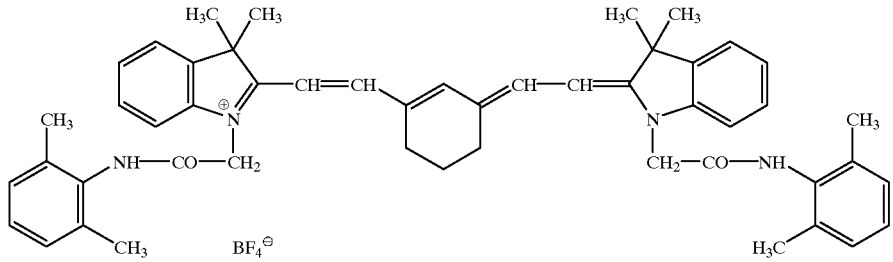
(57)
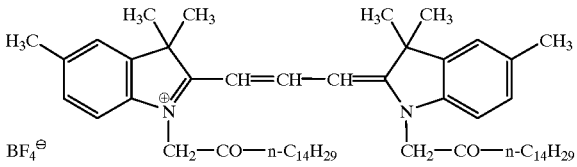
(58)
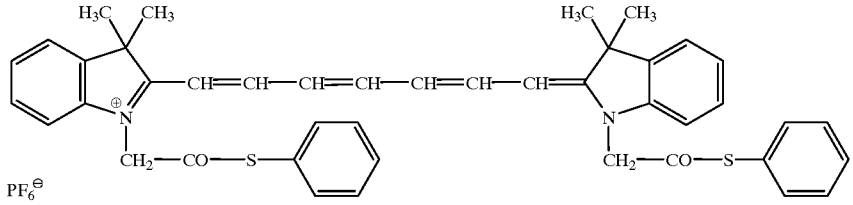
(59)
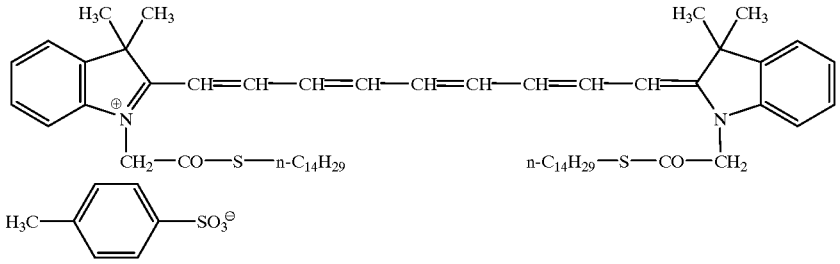

-continued (60)

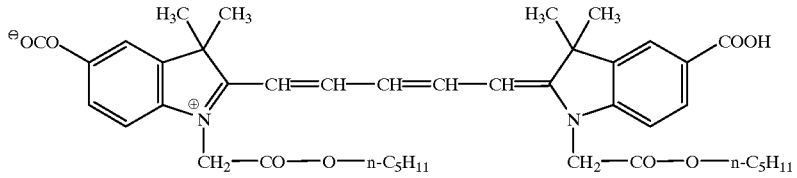

(61)

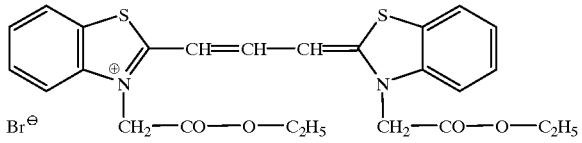

(62)

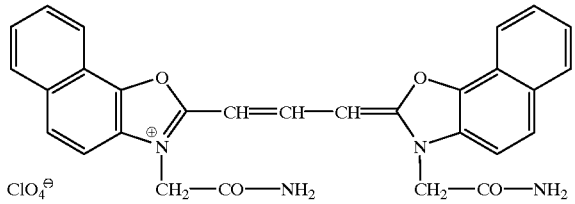

(63)

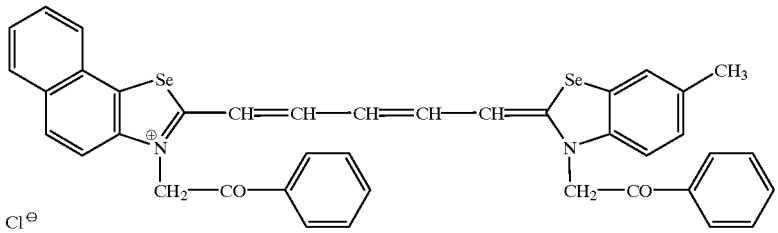

(64)

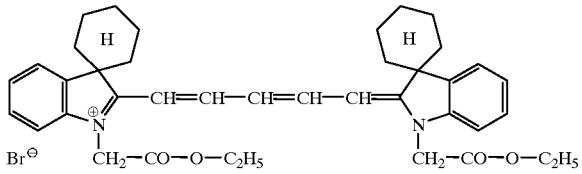

SYNTHESIS EXAMPLE 1

Synthesis of Cyanine Dye (1)

With 30 ml of ethanol, 33.4 g of ethyl bromoacetate and 15.9 g of 2,3,3-trimethylindolenine were mixed. The mixture was refluxed for 5 hours while heating. After the reaction was completed, 50 ml of acetone and 500 ml of ethyl acetate were added to the mixture. Precipitated quaternary salt was filtered off. The yield of the quaternary salt was 25.4 g. The melting point was higher than 250° C.

With 19.0 g of acetic anhydride, 16.3 g of the quaternary salt, 4.9 g of tetramethoxypropane, 75 g of N-methylpyrrolidone and 2.85 g of acetic acid were mixed. The mixture was heated at 50° C. for 3 hours. After the reaction was completed, 50 ml of water was added to the mixture. Precipitated crystals were filtered off, and recrystallized with a mixture of methanol, isopropanol and ethyl acetate. The yield was 13.1 g, the melting point was higher than 250° C., λmax was 637.5 nm, and ϵ was $2.16\times10^5$ (methanol).

SYNTHESIS EXAMPLE 2

Synthesis of Cyanine Dye (3)

With 57 ml of acetic acid, 30.8 g of di(n-butyl) iodoacetamide and 15.9 g of 2,3,3-trimethylindolenine were mixed. The mixture was heated at 100° C. for 10 hours. After the reaction was completed, 11.1 g of 3-anilino-N-phenyl-2-propenylideneimine, 8.1 ml of pyridine, 9.4 ml of acetic anhydride and 30 ml of dimethylformaldehyde were added to the mixture. The resulting mixture was stirred at room temperature for 1 hour. The product was purified by a flash column chromatography. The yield was 14.4 g, the melting point was higher than 250° C., λmax was 639.5 nm, and ϵ was $2.15\times10^5$ (methanol).

Other cyanine dyes can be synthesized in a manner similar to the synthesis examples. The similar synthesis methods are described in Japanese Patent Provisional Publication Nos. 61(1986)-123454 and 7(1995)-333784.

The cyanine dye represented by the formula (I) or a salt thereof can be decolored by heating in the presence of a base. The present inventors have found that an active methylene group of the cyanine dye represented by the formula (I) is deprotonated in the presence of a base to form a nucleophilic spices, which attacks the methine chain to form a substantially colorless intramolecular cyclic compound. The base in the decoloring reaction should have a basicity of deprotoning the active methylene group of the cyanine dye. The ring formed by the decoloring reaction is considered to be a five-membered or seven-membered ring.

The formed substantially colorless compound is stable, and does not return to the cyanine dye. Accordingly, the present invention is free from the problem of color reversion.

The decoloring reaction can be conducted according to a solvent system or a non-solvent system. The solvent system is preferably conducted by heating a solution of a cyanine dye and a base (or base precursor). The solvent is a liquid at a heating temperature (described below), which dissolves the cyanine dye and the base (or base precursor). Examples of the solvents include dimethyl sulfoxide and dimethylacetamide. The non-solvent (dry) system is preferably conducted by heating a sheet on which a cyanine dye and a base (or base precursor) are coated (such as an image recording material or a light-sensitive material). The non-solvent system, namely the image recording material or the light-sensitive material is described below.

The heating temperature at the decoloring reaction is preferably in the range of 40 to 200° C., more preferably in the range of 80 to 150° C., further preferably in the range of 100 to 130° C., and most preferably in the range of 115 to 125° C. The heating time is preferably in the range of 5 to 120 seconds, more preferably in the range of 10 to 60 seconds, further preferably in the range of 12 to 30 seconds, and most preferably in the range of 15 to 25 seconds.

A heat developable light-sensitive material (described below) is heated for heat development. A base is preferably formed by heating a base precursor of a thermal decomposition type. In the case of using the heat developable light-sensitive material or the base precursor, the heating temperature and the heating time is determined by considering the temperature and time for the heat development or the thermal decomposition as well as the above-described decoloring reaction.

The decoloring reaction can use a base in a broad sense. The bases in the broad sense include a nucleophilic agent (Lewis base) as well as a base in a narrow sense. The cyanine dye would be decolored in the presence of a base even at room temperature. Accordingly, the base is preferably separated from the cyanine dye when the base and the dye are stored, and the cyanine dye is preferably contacted with the base when they are heated (when the dye should be decolored). The base can be separated from the cyanine dye by using chemical means or physical means.

The physical separating means include use of microcapsules, addition of a base to hot-melt particles and addition of a base to a layer separated from a layer containing a cyanine dye. The microcapsules can be ruptured by pressure or heat. Microcapsules ruptured by heat (described in Hiroyuki Moriga, Introduction of Chemistry of Specific Paper (written in Japanese, 1975) or Japanese Patent Provisional Publication No. 1(1989)-150575) are advantageously used because the decoloring reaction is conducted at an elevated temperature. One of the base and cyanine dye is contained in the microcapsules for separation. In the case that the shell of the microcapsule is opaque, the base is preferably contained in the microcapsules. The base or the cyanine dye (preferably the base) can be contained in hot-melt particles for separation. The hot-melt particles are formed of a substance that can be melt by heat such as wax. The melting point of the substance is arrange between the room temperature and the above-described heating temperature. In an image recording material or a light-sensitive material, a base can be contained in a layer separated from a layer containing a cyanine dye. A barrier layer containing a hot-melt substance is preferably provided between the layer containing the base and the layer containing the cyanine dye.

The chemical separating means are preferred to the physical separating means. A base precursor is a representative chemical separating means. Various base precursors have been proposed. A precursor of forming (or releasing) a base at an elevated temperature is advantageously used because the decoloring reaction is also conducted at an elevated temperature. A base precursor of a thermal decomposition type is preferred. The base precursor of the thermal decomposition type more preferably consists of a salt of a base with a carboxylic acid (decarboxylation type). When the base precursor of the decarboxylation type is heated, carboxyl of the carboxylic acid is decarboxylated to release a base. The acid preferably has carboxyl that can easily be decarboxylated. In this regard, a sulfonylacetic acid and a propionic acid are preferred. The sulfonylacetic acid and the propionic acid preferably has an aromatic group (an aryl group or an unsaturated heterocyclic group), which has a function of accelerating decarboxylation reaction. A base precursor of a sulfonylacetic salt is described in Japanese Patent Provisional Publication No. 59(1984)-168441. A base precursor of a propionic salt is described in Japanese Patent Provisional Publication No. 59(1984)-180537.

The base precursor of the decarboxylation type preferably contains an organic base as a base component. The organic base preferably is an amidine, a guanidine or their derivatives. The organic base also preferably is a diacidic, triacidic or tetraacidic base, more preferably is a diacidic base, and most preferably is a diacidic base of an amidine or guanidine derivative.

A precursor of a diacidic, triacidic or tetraacidic base of an amidine derivative is described in Japanese Patent Publication No. 7(1995)-59545. A precursor of a diacidic, triacidic or tetraacidic base of a guanidine derivative is described in Japanese Patent Publication No. 8(1996)-10321.

The diacidic base of the amidine or guanidine derivative comprises (A) two amidine or guanidine moieties, (B) substituent groups of the amidine or guanidine moieties and (C) a divalent linking group combining the two amidine or guanidine moieties. Examples of the substituent groups of (B) include an alkyl group (including a cycloalkyl group), an alkenyl group, an alkynyl group, an aralkyl group and a heterocyclic group. Two or more substituent groups can be combined to form a nitrogen-containing heterocyclic group. The linking group of (C) preferably is an alkylene group or phenylene.

Examples of the diacidic base precursors of the amidine or guanidine derivatives are shown below.

(BP-1)

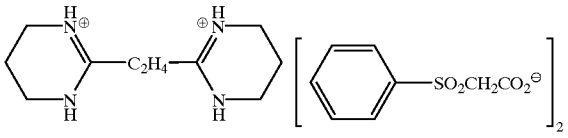

(BP-2)

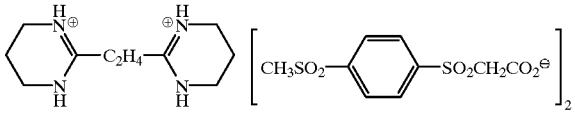

-continued
(BP-3)
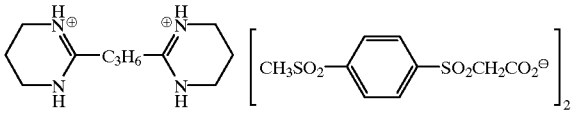
(BP-4)
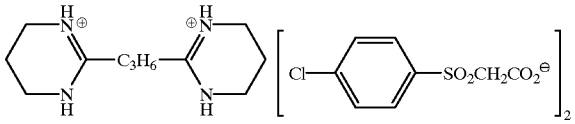
(BP-5)
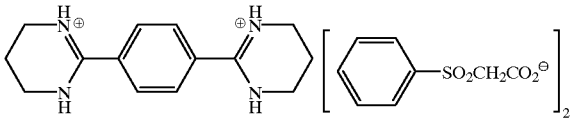
(BP-6)
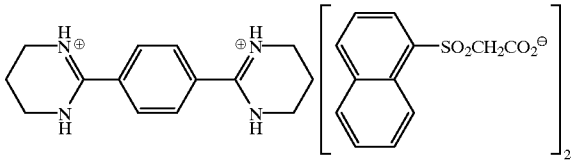
(BP-7)
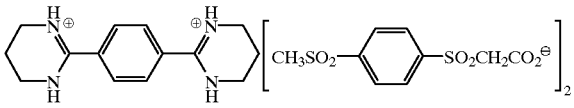
(BP-8)
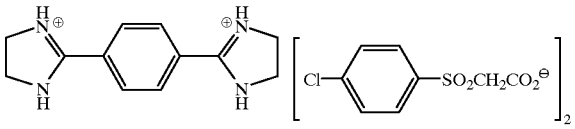
(BP-9)
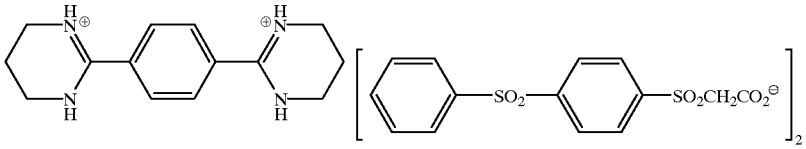
(BP-10)
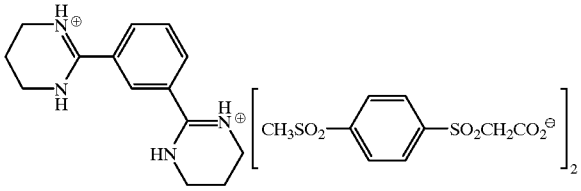
(BP-11)
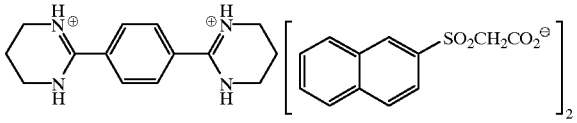
(BP-12)
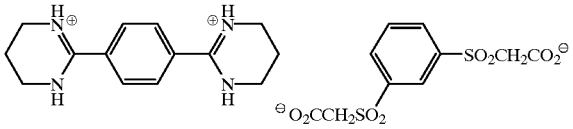
(BP-13)
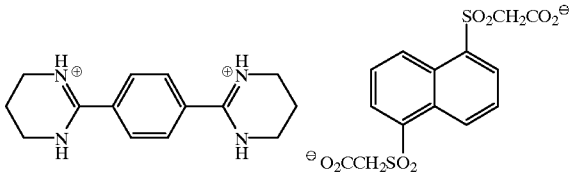
(BP-14)
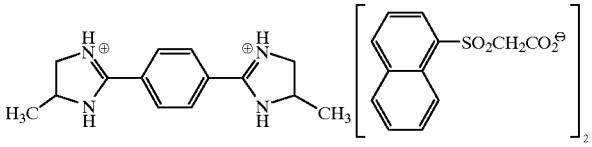
(BP-15)
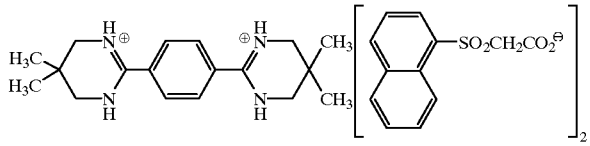
(BP-16)
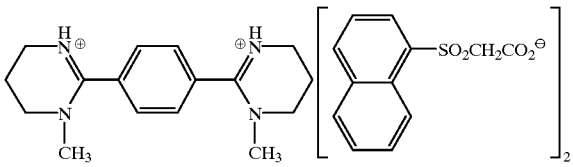

-continued
(BP-17)
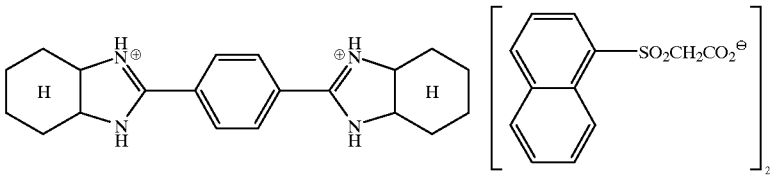
(BP-18)
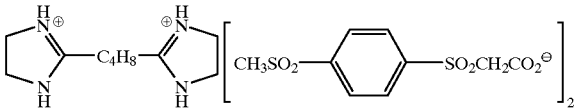
(BP-19)
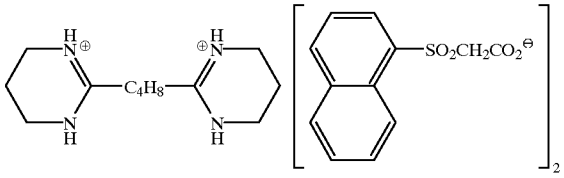
(BP-20)
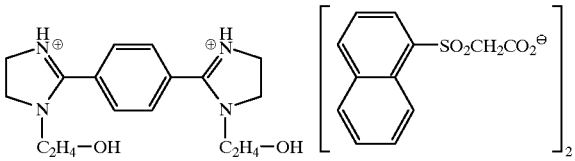
(BP-21)
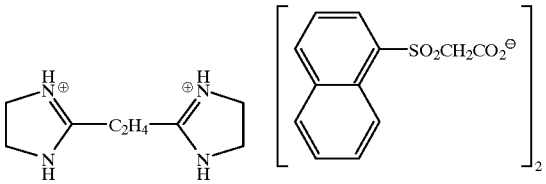
(BP-22)
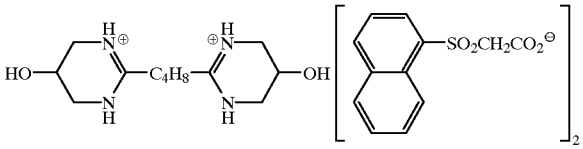
(BP-23)
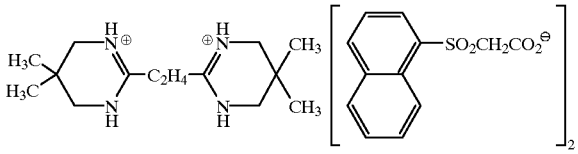
(BP-24)
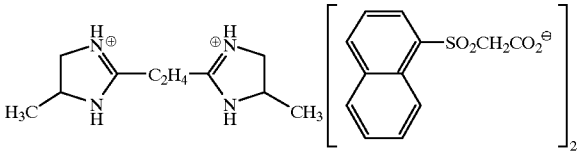
(BP-25)
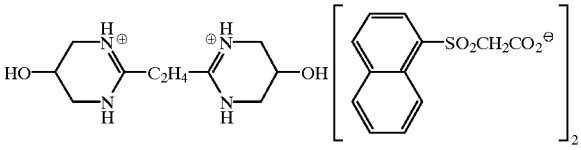
(BP-26)
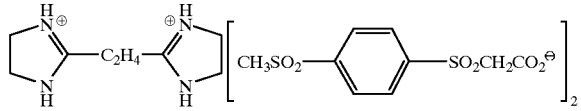
(BP-27)
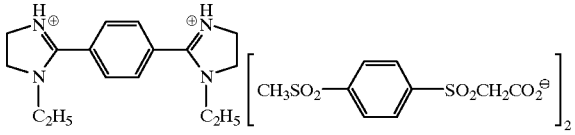
(BP-28)
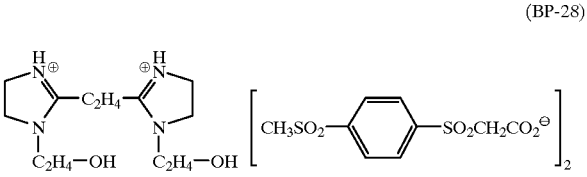
(BP-29)
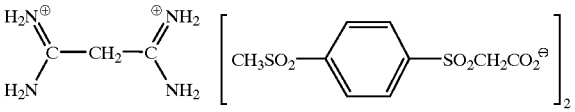
(BP-30)
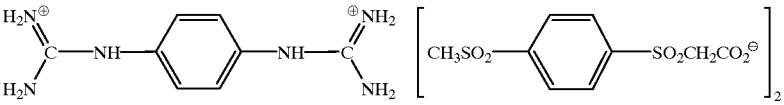

-continued (BP-31)

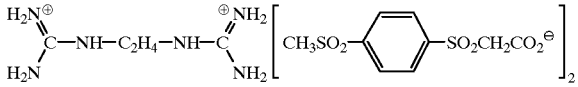

(BP-32)

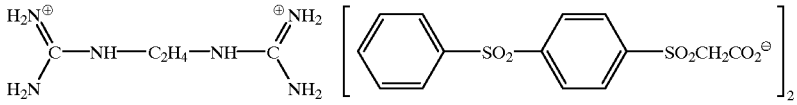

(BP-33)

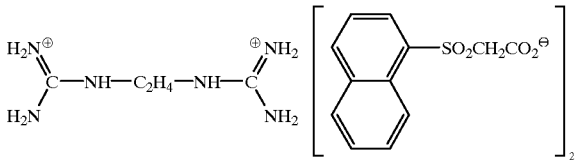

(BP-34)

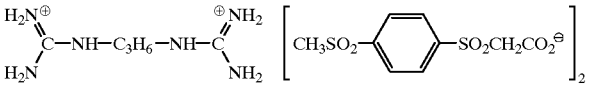

(BP-35)

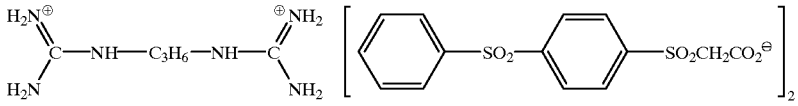

(BP-36)

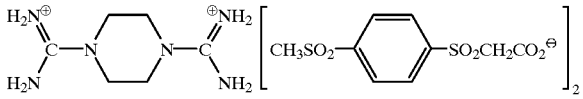

(BP-37)

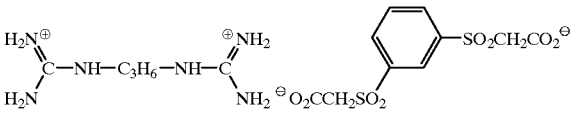

(BP-38)

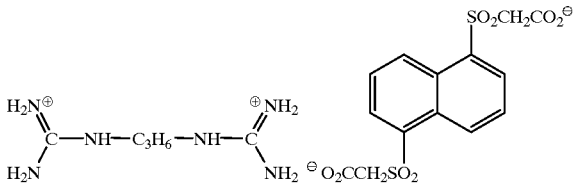

(BP-39)

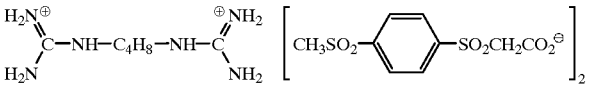

(BP-40)

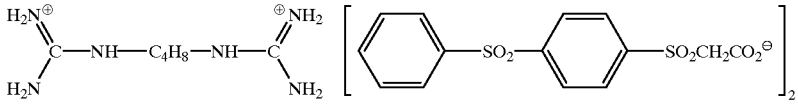

(BP-41)

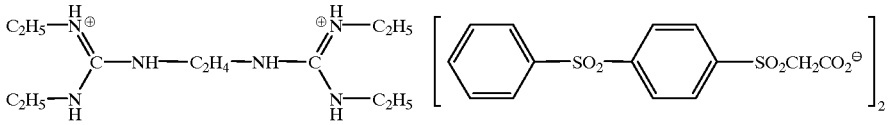

The amount (mol) of the base precursor is preferably 1 to 100 times, and more preferably 3 to 30 times of the amount (mol) of the cyanine dye.

The cyanine dye can be used in various technical fields to make an advantage of the above-described decoloring reaction. For example, a solution of a cyanine dye and a base precursor can be used as an ink, which can be decolored by heat. Further, the solution can be coated on a transparent support to form a color sheet (filter), which can be decolored by heat.

The cyanine dye and the base precursor can be used in a thermal image recording material, which comprises a support (preferably transparent support) and an image recording layer. The image recording-layer contains the cyanine dye and the base precursor. The image recording layer can be formed by coating a solution or dispersion of the dye and the base precursor on the support. The cyanine dye is preferably in the form of solid particles, which are dispersed in the image recording layer. The cyanine dye in the form of the solid particles can be formed by using a dispersion of the dye. The base precursor is also preferably in the form of solid particles. The image recording layer preferably further contains a binder. The binder preferably is a hydrophilic polymer (e.g., polyvinyl alcohol, gelatin).

The thermal image recording material is imagewise heated to form a decolored image within the heated area. The material can easily be imagewise heated by using a thermal head, which is attached to a facsimile machine or a thermal printer. The heating temperature is preferably in the range of 80 to 200° C., and more preferably in the range of 100 to 200° C.

The cyanine dye can be advantageously used in a heat developable light-sensitive material. The cyanine dye and the base precursor is added to a non-light-sensitive layer of the light-sensitive material. The non-light-sensitive layer containing the cyanine dye can function as a filter layer or an antihalation layer. The heat developable light-sensitive material usually comprises a non-light-sensitive layer as well as a light-sensitive layer. In view of arrangement, the non-light-sensitive layer can be classified into (1) an overcoating layer provided on a light-sensitive layer, (2) an intermediate layer provided between light-sensitive layers, (3) an undercoating layer provided between a support and a light-sensitive layer and (4) a backing layer provided on a support (the side on which a light-sensitive layer is not provided). The filter layer is provided on the light-sensitive material as (1) an overcoating layer or (2) an intermediate layer. The antihalation layer is provided as (3) an undercoating layer or (4) a backing layer.

The cyanine dye and the base precursor is preferably contained in the same non-light-sensitive layer. The cyanine dye and the base precursor can be contained in separated but adjacent two layers respectively. A barrier layer can be further provided between two layers. In the present specification, the expression "layer contains a cyanine dye and a base precursor" includes the case that two layers contains the cyanine dye and the base precursor separately.

The cyanine dye can be contained in the non-light-sensitive layer by adding a solution, emulsion, solid particle dispersion or polymer impregnant of the dye to a coating solution of the layer. Further, the dye can be added to the non-light-sensitive layer by using a polymer mordant.

A latex (described in U.S. Pat. No. 4,199,363, German Patent Publication Nos. 2,541,230, 2,541,274, European Patent Publication No. 029,104 and Japanese Patent Publication No. 53(1978)-41091) can be used for the polymer impregnant. An emulsion of a dye can be prepared by adding the cyanine dye to a polymer solution and emulsifying the polymer solution, as is described in International Patent Publication No. 88/00723.

The amount of the cyanine dye depends on use of the dye. The amount of the dye is usually so adjusted that the optical density (absorbance) at a desired wavelength is higher than 0.1. The optical density is preferably in the range of 0.2 to 2. The amount of the dye for the abovementioned optical density is usually in the range of 0.001 to 1 g per $m^2$. After the cyanine dye is decolored according to the present invention, the optical density can be reduced to not higher than 0.1.

Two or more cyanine dyes can be used in combination. Two or more base precursors can also be used in combination.

The heat developable light-sensitive material is described below in more detail.

The heat developable light-sensitive material preferably is a monosheet type, which means that an image can directly be formed on a heat developable light-sensitive material without using another sheet such as an image-receiving material.

The heat developable light-sensitive material has a light-sensitive layer containing silver halide (an catalytically active amount of photo catalyst) and a reducing agent. The light-sensitive layer preferably further contains a binder (usually a synthetic polymer), an organic silver salt (reducible silver source), a hydrazine compound (ultra-hard gradation agent) and a color toning agent (controlling color tone of silver). Two or more light-sensitive layers may be provided in the light-sensitive material. For example, a high sensitive layer and a low sensitive layer can be provided in the heat developable light-sensitive material to control gradation. The high- sensitive layer and the low sensitive layer may be arranged in any order. For example, the low sensitive layer may be arranged on the lower side (support side), or the high sensitive layer may be arranged on the lower side.

The heat developable light-sensitive material further has a non-light-sensitive layer containing the cyanine dye and the base precursor, as is described above. The light-sensitive material can furthermore has another non-light-sensitive layer such as a surface protective layer.

Examples of the support of the heat developable light-sensitive material include a paper, a paper coated with polyethylene, a paper coated with polypropylene, a parchment, a cloth, a sheet or a thin film of metal (e.g., aluminum, copper, magnesium, zinc), a glass board, a glass board coated with metal (e.g., chromium alloy, steel, silver, gold, platinum) and a plastic film. Examples of the plastics used for the support include polyalkyl methacrylate (e.g., polymethyl methacrylate), polyester (e.g., polyethylene terephthalate), polyvinyl acetal, polyamide (e.g., nylon) and cellulose ester (e.g., cellulose nitrate, cellulose acetate, cellulose acetate propionate, cellulose acetate butyrate).

The support may be coated with a polymer. Examples of the polymers include polyvinylidene chloride, an acrylic acid polymer (e.g., polyacrylonitrile, polymethyl acrylate), a polymer of an unsaturated dicarboxylic acid (e.g., itaconic acid), carboxymethyl cellulose and polyacrylamide. A copolymer can also be used. In place of coating a polymer on the support, an undercoating layer containing a polymer can be provided on the support.

Silver bromide, silver iodide, silver chloride, silver chlorobromide, silver iodobromide or silver chloroiodobromide can be used as silver halide. Silver halide preferably contains silver iodide.

The silver halide is used in an amount of preferably 0.03 to 0.6 g per $m^2$, more preferably 0.05 to 0.4 g per $m^2$, and most preferably 0.1 to 0.4 g per $m^2$.

The silver halide is generally prepared in the form of a silver halide emulsion by a reaction of silver nitrate with a soluble halogen salt. The silver halide may be prepared by causing silver soap to react with a halogen ion and thereby subject the soap moiety of the silver soap to halogen conversion. A halogen ion may be added during the formation of the silver soap.

As the reducing agent, phenidone, hydroquinone, catechol or hindered phenol is preferable. The reducing agent is described in U.S. Pat. Nos. 3,770,448, 3,773,512, 3,593,863, 4,460,681, and Research Disclosure Nos. 17029 and 29963.

Examples of the reducing agents include aminohydroxycycloalkenone compounds (e.g., 2-hydroxy-piperidine-2-cyclohexenone), N-hydroxyurea derivatives (e.g., N-p-methylphenyl-N-hydroxyurea), hydrazones of aldehyde or ketone (e.g., anthracenealdehyde phenylhydrazone), phosphamide phenols, phosphamide anilines, polyhydroxybenzenes (e.g., hydroquinone, t-butyl-hydroquinone, isopropylhydroquinone, 2,5-dihydroxy-phenylmethylsulfone), sulfohydroxamic acids (e.g., benzenesulfohydroxamic acid), sulfonamideanilines (e.g., 4-(N-methanesulfonamide) aniline), 2-tetrazolylthiohydroquinones (e.g., 2-methyl-5-(1-phenyl-5-tetrazolylthio)hydroquinone), tetrahydroquinoxalines (e.g., 1,2,3,4-tetrahydroquninoxaline.), amidoxines, combinations of azines (e.g., aliphatic carboxylic acid arylhydrazides) and ascorbic acid, combination of polyhydroxybenzene and hydroxyamine, reductone, hydrazine, hydroxamic acids, combinations of azines and sulfonamidophenols, α-cyanophenylacetic acid derivative, combination of bis-β-naphthol and 1,3-dihydroxybenzene derivative, 5-pyrazolones, sulfonamidophenols, 2-phenylindane-1,3-dione, chroman, 1,4-dihydropyridines (e.g., 2,6-dimethoxy-3,5-dicarboethoxy-1,4-dihydropyridine), bisphenols (e.g., bis(2-hydroxy-3-t-butyl-5-methylphenyl)methane, bis(6-(hydroxy-m-tri)mesitol, 2,2-bis(4-hydroxy-3-methylphenyl)propane, 4,4-ethylidene-bis(2-t-butyl-6-methyl)phenol), ultraviolet-sensitive ascorbic acid derivative and 3-pyrazolidone.

An ester of aminoreductone which functions as a precursor of a reducing agent (e.g., piperidinohexose reductone monoacetate) can be used as the reducing agent.

A particularly preferred reducing agent is a hindered phenol.

The light-sensitive layer and the non-light-sensitive layer preferably contain a binder. As the binder, a colorless, transparent or translucent polymer is generally employed. A natural polymer or a semisynthetic polymer (e.g., gelatin, gum arabic, hydroxyethyl cellulose, cellulose ester, casein, starch) is employable, but a synthetic polymer is preferable to the natural or semisynthetic polymer in consideration of heat resistance. Though the cellulose ester (e.g., acetate, cellulose acetate butyrate) is a semisynthetic polymer, it is preferably used as a binder of the heat developable light-sensitive material because it is relatively resistant to heat.

Examples of the synthetic polymers include polyvinyl alcohol, polyvinyl pyrrolidone, polyacrylic acid, polymethyl methacrylate, polyvinyl chloride, polymethacrylic acid, styrene/maleic anhydride copolymer, styrene/acrylonitrile copolymer, styrene/butadiene copolymer, polyvinyl acetal (e.g., polyvinyl formal, polyvinyl butyral), polyester, polyurethane, phenoxy resin, polyvinylidene chloride, polyepoxide, polycarbonate, polyvinyl acetate and polyamide. A hydrophobic polymer is preferable to a hydrophilic polymer. Of these, therefore, preferable are styrene/acrylonitrile copolymer, styrene/butadiene copolymer, polyvinyl acetal, polyester, polyurethane, cellulose acetate butyrate, polyacrylic acid, polymethyl methacrylate, polyvinyl chloride and polyurethane. More preferable are styrene/butadiene copolymer and polyvinyl acetal.

The binder is used by dissolving or emulsifying it in a solvent (water or organic solvent) of a coating solution for forming the light-sensitive layer or the non-light-sensitive layer. When the binder is emulsified in the coating solution, an emulsion of the binder may be mixed with the coating solution.

The amount of the binder in the layer containing the dye is preferably adjusted so that the coating weight of the dye is 0.1 to 60 wt % of the binder. The coating weight of the dye is more preferably 0.2 to 30 wt % of the binder, most preferably 0.5 to 10 wt % of the binder.

The light-sensitive layer or the non-light-sensitive layer preferably further contains an organic silver salt. An organic acid for forming the silver salt is preferably a long-chain fatty acid. The fatty acid preferably has 10 to 30 carbon atoms, and more preferably has 15 to 25 carbon atoms. A complex of the organic silver salt is also available. The ligand of the complex preferably has a total stability constant against the silver ion in the range of 4.0 to 10.0. The organic silver salt is described in Research Disclosure Nos. 17029 and 29963.

Examples of the organic silver salts include a silver salt of a fatty acid (e.g., gallic acid, oxalic acid, behenic acid, stearic acid, palmitic acid, lauric acid), a silver salt of carboxyalkylthiourea (e.g., 1-(3-carboxypropyl)thiourea, 1-(3-carboxypropyl)-3,3-dimethylthiourea), a silver complex of a polymer reaction product of aldehyde (e.g., formaldehyde, acetaldehyde, butylaldehyde) and a hydroxy-substituted aromatic carboxylic acid, a silver salt of an aromatic carboxylic acid (e.g., salicylic acid, benzoic acid, 3,5-dihydroxybenzoic acid, 5,5-thiodisalicyclic acid), a silver salt or a silver complex of thioene (e.g., 3-(2-carboxyethyl)-4-hydroxymethyl-4-thiazoline-2-thioene, 3-carboxymethyl-4-thiazoline-2-thioene), a silver salt or a silver complex of nitrogen acid (e.g., imidazole, pyrazole, urazole, 1,2,4-thiazole, 1H-tetrazole, 3-amino-5-benzylthio-1,2,4-triazole, benzotriazole), a silver salt of saccharin, a silver salt of 5-chlorosalicylaldoxime, and a silver salt of mercaptide. Most preferable is the silver behenate. The organic acid silver salt is used in an amount of preferably not more than 3 g/m$^2$, more preferably not more than 2 g/m$^2$, in terms of silver.

The light-sensitive layer or the non-light-sensitive layer preferably further contains an ultra-hard gradation agent. When the heat developable light-sensitive material is used in the field of printing photography, reproduction of continuous gradation dot image or line image is important. By the use of the ultra-hard gradation agent, the reproducibility of the dot image or the line image can be improved. As the ultra-hard gradation agent, a hydrazine compound, a quaternary ammonium compound or an acrylonitrile compound (described in U.S. Pat. No. 5,545,515) is employed. The hydrazine compound is particularly preferable as the ultra-hard gradation agent.

The hydrazine compound includes hydrazine ($H_2N–NH_2$) and a compound wherein at least one hydrogen of said hydrazine is substituted. As for the substituent group, its aliphatic group, aromatic group or heterocyclic group is directly attached to the nitrogen atom of the hydrazine, or its aliphatic group, aromatic group or heterocyclic group is attached to the hydrazine through a connecting group. Examples of the connecting groups include —CO—, —CS—, —$SO_2$—, —P(=O)R— (R is an aliphatic group, an aromatic group or a heterocyclic group), —CNH— and combinations thereof.

The hydrazine compound is described in U.S. Pat. Nos. 5,464,738, 5,496,695, 5,512,411, 5,536,622, Japanese Patent Publication Nos. 6(1994)-77138, 6(1994)-93082, and Japanese Patent Provisional Publication Nos. 6(1994)-230497, 6(1994)-289520, 6(1994)-313951, 7(1995)-5610, 7(1995)-77783 and 7(1995)-104426.

The hydrazine compound can be added to a coating solution for forming the light-sensitive layer by dissolving it in an appropriate organic solvent. Examples of the organic solvents include alcohol (e.g., methanol, ethanol, propanol, fluorinated alcohol), ketone (e.g., acetone, methyl ethyl ketone), dimethylformamide, dimethyl sulfoxide and methyl cellosolve. A solution obtained by dissolving the hydrazine compound in an oily (co)solvent may be emulsified in the coating solution. Examples of the oily (co)solvents include dibutyl phthalate, tricresyl phosphate, glycerol triacetate, diethyl phthalate, ethyl acetate and cyclohexanone. A solid dispersion of the hydrazine compound may be added to the coating solution. The hydrazine compound can be dispersed using a known dispersing machine such as a ball mill, a colloid mill, a Mantongoring, a microfluidizer or an ultrasonic dispersing machine.

The ultra-hard gradation agent is used in an amount of preferably $1\times10^{-6}$ to $1\times10^{-2}$ mol, more preferably $1\times10^{-5}$ to $5\times10^{-3}$ mol, most preferably $2\times10^{-5}$ to $5\times10^{-3}$ mol, based on 1 mol of the silver halide.

In addition to the ultra-hard gradation agent, a hard gradation accelerator may be used. Examples of the hard gradation accelerators include an amine compound (described in U.S. Pat. No. 5,545,505), a hydroxamic acid (described in U.S. Pat. No. 5,545,507), acrylonitriles (described in U.S. Pat. No. 5,545,507) and a hydrazine compound (described in U.S. Pat. No. 5,558,983).

The light-sensitive layer or the non-light-sensitive layer preferably further contains a color toning agent. The color toning agent is described in Research Disclosure No. 17029.

Examples of the color toning agents include imides, (e.g., phthalimide), cyclic imides (e.g., succinimide), pyrazoline-5-ones (e.g., 3-phenyl-2-pyrazoline-5-one, 1-phenylurazole), quinazolinones (e.g., quinazoline, 2,4-thiazolidinedione), naphthalimides (e.g., N-hydroxy-1,8-naphthalimide), cobalt complex (e.g., hexamine cobalt trifluoroacetate), mercaptans (e.g., 3-mercapto-1,2,4-triazole), N-(aminomethyl)aryldicarboxyimides (e.g., N-(dimethylaminomethyl)phthalimide), blocked pyrazoles (e.g., N,N'-hexamethylene-1-carbamoyl-3,5-dimethylpyrazole), combination of isothiuronium derivative (e.g., 1,8-(3,6-dioxaoctane)-bis(isothiuronium trifluoroacetate) and a photo bleaching agent (e.g., 2-(tribromomethylsulfonyl)benzothiazole), merocyanine dye (e.g., 3-ethyl-5-((3-ethyl-2-benzothiazolinylidene)-1-methylethylidene)-2-thio-2,4-oxazolidinedione), a phthalazinone compound and a metallic salt thereof (e.g., phthalazinone, 4-(1-naphthyl)phthalazinone, 6-chlorophthalazinone, 5,7-dimethyloxyphthalazinone, 2,3-dihydro-1,4-phthalazinone, 8-methylphthalazinone), combination of a phthalazinone compound and sulfinic acid derivative (e.g., sodium benzenesulfinate), combination of a phthalazinone compound and sulfonic acid derivative (e.g., sodium p-toluenesulfonate), combination of phthalazine and phthalic acid, combination of phthalazine or phthalazine adduct and dicarboxylic acid (preferably o-phenylene acid) or anhydride thereof (e.g., maleic anhydride, phthalic acid, 2,3-naphthalenedicarboxylic acid, phthalic anhydride, 4-methylphthalic acid, 4-nitrophthalic acid, tetrachlorophthalic anhydride), quinazolinediones, benzoxazine, naphthoxazine derivative, benzoxazine-2,4-diones (e.g., 1,3-benzoxazine-2,4-dione), pyrimidines, asymmetric triazines (e.g., 2,4-dihydroxypyrimidine), tetrazapentalene derivative (e.g., 3,6-dimercapto-1,4-diphenyl-1H, 4H-2,3a, 5, 6a-tetrazapentalene), and phthalazine. Phthalazine is particularly preferred.

The light-sensitive layer or the non-light-sensitive layer (preferably non-light-sensitive layer) can contain an antifogging agent. A mercury-free antifogging agent (described in U.S. Pat. Nos. 3,874,946, 4,546,075, 4,452,885, 4,756,999, 5,028,523, British Patent Nos. 92221383.4, 9300147.7, 9311790.1, Japanese Patent Provisional Publication No. 59(1984)-57234) is preferred to a mercury antifogging agent (described in U.S. Pat. No. 3,589,903).

A heterocyclic compound having a methyl group substituted with halogen (F, Cl, Br or I) is preferably used as the antifogging agent.

In the use of the silver halide, the silver halide is generally subjected to spectral sensitization. In the present invention, the silver halide is preferably spectrally sensitized in the near infrared region. The spectral sensitizing dye is described in Japanese Patent Provisional Publication Nos. 60(1985)-140336, 63(1988)-159841, 63(1988)-231437, 63(1988)-259651, 63(1988)-304242, 63(1988)-15245, and U.S. Pat. Nos. 4,639,414, 4,740455, 4,741,966, 4,751,175 and 4,835,096.

Into the heat developable light-sensitive material, various additives such as a surface active agent, an antioxidant, a stabilizer, a plasticizer, an ultraviolet light absorber and a coating aid may be incorporated. The additives are added to either the light-sensitive layer or the non-light-sensitive layer.

The heat developable light-sensitive material is preferably imagewise exposed to a near infrared light. The present invention is particularly effective for the exposure to the near infrared light (particularly near infrared laser). The wavelength of the near infrared light is in the range of preferably 700 to 1,100 nm, more preferably 750 to 860 nm, most preferably 780 to 830 nm. Examples of the near infrared light sources employable in the invention include a xenon flash lamp, various laser sources and light emitting diode.

After the imagewise exposure, the heat developable light-sensitive material is heated to perform development. Through the heat development, a black silver image is formed. The heating temperature is in the range of preferably 80 to 250° C., more preferably 100 to 200° C. The heating time is in the range of usually 1 second to 2 minutes.

EXAMPLE 1

Decoloring Reaction of Cyanine Dye

In 10 ml of dimethyl sulfoxide, 0.73 g of the cyanine dye (47) was dissolved. To the solution, 0.7 ml of triethylamine was added. The mixture was heated at 120° C. for 1 minute. Immediately after heating the mixture, the blue color of the solution disappeared, and the color of the solution was turned to pale yellow. The solution was left to cool it, and precipitated white crystals were filtered off. The obtained crystals were made of a strongly hydrophobic and neutral compound. The compound was subjected to a mass spectral analysis. As a result, the molecular weight of the compound was 626, which means that the compound is formed by removing the counter anion and one proton atom from the cyanine dye (47). Further, the results of $^1$H-NMR spectral analysis confirmed that the compound was decolored by a ring forming reaction.

The experiment was repeated except that 1,8-diazabicyclo[5,4,0]-7-undecene, guanidine or sodium hydroxide was used in place of triethylamine (base). The results of the experiments also confirmed that the dye was decolored by a ring forming reaction.

Further, the cyanine dye was dissolved in dimethyl sulfoxide-$d_6$ (substituted with heavy hydrogen) without use of triethylamine. The solution was heated at 160° C. for 2 hours. The solution was subjected to $^1$H-NMR spectral analysis. As a result, no reactions were confirmed. The result confirmed that the cyanine dye was very stable without a base.

The experiments were further repeated, except that the cyanine dye (1), (48), (49), (2) or (4) was used in place of the cyanine dye (47). The results of the experiments also confirmed that the dye was decolored by a ring forming reaction.

EXAMPLE 2

Decoloring Reactions of Various Dyes

To a dimethylacetamide solution ($1\times10^{-5}$ mol per dm$^3$) of the dye set forth in Table 1, the base precursor ($1\times10^{-4}$ mol per $dm^3$) was added. The mixture was heated at 110° C. for 30 seconds. The absorbance at the primary absorption band (λmax) was measured to determine the remaining ratio of the dye. The results are set forth in Table 1.

TABLE 1

| Dye | λmax | Remaining ratio |
|---|---|---|
| (1) | 645.8 nm | 0.2% |
| (47) | 682.4 nm | 0.0% |
| (48) | 550.8 nm | 0.2% |
| (2) | 647.2 nm | 0.3% |
| (3) | 647.2 nm | 1.1% |
| (5) | 647.0 nm | 1.5% |
| (6) | 645.5 nm | 0.0% |
| (61) | 566.0 nm | 0.2% |
| Comparative dye 1 | 644.0 nm | 24.3% |
| Comparative dye 2 | 679.4 nm | 98.6% |
| Comparative dye 3 | 646.2 nm | 38.7% |

(Comparative dye 1)

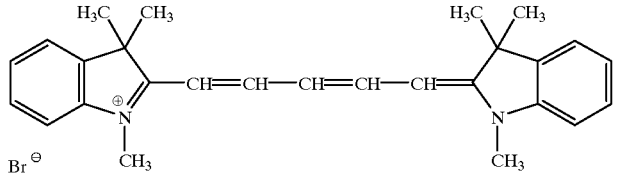

(Comparative dye 2)

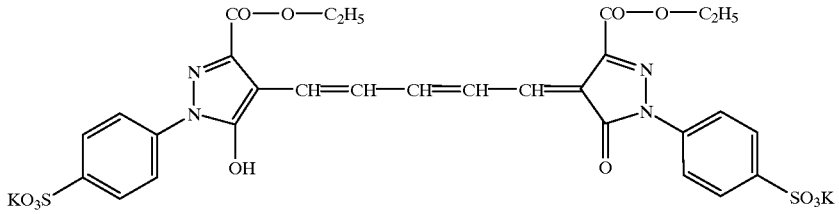

(Comparative dye 3)

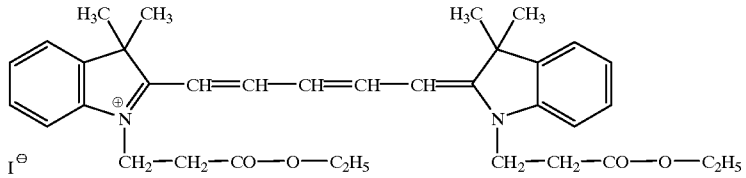

EXAMPLE 3

Preparation of Solid Particle Dispersion of Base Precursor

In a dispersing container of 300 ml, 52.5 g of 3 wt. % aqueous solution of polyvinyl alcohol, 52.5 g of 3 wt. % aqueous solution of carboxymethyl cellulose, 40 g of the base precursor (BP-41) and 150 ml of glass beads (diameter: 0.5 to 0.75 mm) were placed. The mixture was stirred at 3,000 rpm for 30 minutes in a Dynomill dispersing device. The dispersion was adjusted to pH 6.5 by using 2N sulfuric acid to obtain a solid particle dispersion of the base precursor (BP-41). The average particle size was about 1 μm.

Preparation of Particle Dispersion of Dye

In 30 g of ethyl acetate, 2.1 g of the cyanine dye (3) was dissolved.

Independently, 31 g of 20 wt. % aqueous solution of polyvinyl alcohol and 21 g of water were mixed with 10 g of 5 wt. % aqueous solution of sodium dodecylbenzenesulfonate. The mixture was place in a homogenizer cup of 200 ml. The solution of the dye was added to the mixture. The resulting mixture was stirred at 10,000 rpm for 5 minutes to obtain an emulsion of the dye. The emulsion was stirred at 50° C. for 2 hours. After ethyl acetate was removed from the emulsion, water (the amount of evaporated water) was added to the emulsion to obtain a particle dispersion of the cyanine dye (3). The average particle size was about 0.4 μm.

Preparation of Thermal Image Recording Material

To 5.1 g of the particle dispersion of the cyanine dye, 0.5 g of water and 20 wt. % aqueous solution of polyvinyl alcohol were mixed. To the mixture, 2 g of the solid particle dispersion of the base precursor was added to prepare a coating solution of an image recording layer. The coating solution was coated on a gelatin undercoating layer of a polyethylene film support (thickness: 100 μm), and dried. The coating amount was 10.5 g per $m^2$.

With 4.8 g of water, 4 g of 10 wt. % aqueous solution of polyvinyl alcohol, 1 g of 2 wt. % aqueous solution of poly(n=1)ethylene glycol dodecyl ether (surface active agent) and 0.5 g of 20 wt. % aqueous dispersion of zinc stearate (average particle size: 0.2 μm) were mixed to prepare a coating solution of a protective layer. The coating solution was coated on the image recording layer, and dried. The coating amount was 17.5 g per $m^2$.

Thus, a thermal image recording material was prepared.

Thermal Image Formation

The thermal image recording material was imagewise heated by using a thermal imager (FTI210, Fuji Photo Film Co., Ltd.) at 8 gradation steps to form a negative image in which an area of high energy was decolored.

Independently, the thermal image recording material was stored at 40° C. and at the relative humidity of 80% for 3 days. As a result, the image recording layer was not decolored. The stored thermal image recording material was imagewise heated in the same manner as is described above. As a result, a similar clear negative image was formed.

EXAMPLE 3

Preparation of Solid Particle Dispersion of Base Precursor

With 43.5 g of water, 5.12 g of the base precursor (BP-7) and 1.02 g of polyvinyl alcohol were mixed. The mixture was stirred in a sand mill (1/16G sand grinder mill, Aimex Co., Ltd.) to prepare a solid particle dispersion of the base precursor (BP-7).

Preparation of Emulsion of Dye

In 35 g of ethyl acetate, 1.2 g of the cyanine dye (3) was dissolved to form an organic phase. The organic phase was mixed with 84 g of 6 wt. % aqueous solution of polyvinyl alcohol. The mixture was emulsified at room temperature to prepare an emulsion of the cyanine dye (3). The average particle size was 1.2 μm.

Preparation of Coatina Solution of Antihalation Layer

With 28 g of 4 wt. % aqueous solution of polyvinyl alcohol, 4 g of the solid particle dispersion of the base precursor and 4 g of the emulsion of the dye were mixed. The mixture was stirred to prepare a coating solution of an antihalation layer.

Formation of Antihalation Layer

A moistureproofing undercoating layer containing vinylidene chloride was formed on one side of a polyethylene terephthalate film support (thickness; 175 μm). A gelatin undercoating layer was formed on the other side of the support. The coating solution of the antihalation layer was coated on the moistureproofing undercoating layer, and dried to form an antihalation layer (dry coating amount: 2 g per $m^2$).

Preparation of Silver Halide Emulsion

In 700 ml of water, 22 g of phthalated gelatin and 30 mg of potassium bromide were dissolved. The solution was adjusted to pH 5.0 at 35° C. for 5 minutes. To the solution, 159 ml of an aqueous solution containing 18.6 g of silver nitrate and 0.9 g of ammonium nitrate and an aqueous solution of potassium bromide and potassium iodide (molar ratio 92:8) were added for 10 minutes according to a controlled double jet method while keeping pAg of 7.7. To the mixture, 476 ml of an aqueous solution containing 55.4 g of silver nitrate and 2 g of ammonium nitrate and an aqueous solution of dipotassium hexachloroiridate (10 μ mole per liter) and potassium bromide (1 mole per liter) were added for 30 minutes according to a controlled double jet method while keeping pAg of 7.7. Further, 1 g of 4-hydroxy-6-methyl-1,3,3a,7-tetraazaindene was added to the mixture. The pH of the emulsion was lowered to cause sedimentation, and the emulsion was desalted. To the emulsion 0.1 g of phenoxyethanol was added. The emulsion was adjusted to pH 5.9 and pAg 8.2 to complete formation of silver iodobromide grains. The iodide content in the core was 8 mol %, and the average iodide content in the whole grains was 2 mol %. The average grain size was 0.05 μm, the distribution coefficient of the projected area was 8%, the ratio of (100) face was 88%, and the grain shape was cubic.

The emulsion was heated to 60° C. To the emulsion, 85 μ mole (based on 1 mole of silver) of sodium thiosulfate, 11 μ mole of 2,3,4,5,6-heptafluorophenyldiphenyl phosphineselenide, 15 μ mole of the following tellurium compound, 3.5 μ mole of chloroauric acid and 270 μ mole of thiocyanic acid was added. The emulsion was ripened for 120 minutes, and quickly cooled to 30° C. to obtain a silver halide emulsion.

(Tellurium compound)

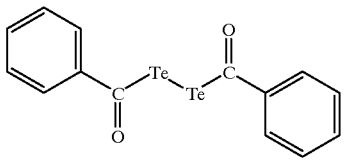

Preparation of Organic Silver Salt Emulsion

To 850 ml of distilled water, 7 g of stearic acid, 4 g of arachidic acid and 36 g of behenic acid were added. While stirring the mixture vigorously at 90° C., 187 ml of 1N aqueous solution of sodium hydroxide was added to the mixture. The resulting mixture was stirred for 60 minutes.

After 60 ml of 1N nitric acid was added to the mixture, the resulting mixture was cooled to 50° C. While stirring the mixture more vigorously, 0.62 g of N-bromosuccinimide was added to the mixture. After 10 minutes, the silver halide emulsion (amount of silver halide: 6.2 mmole) was added to the mixture. Further, 125 ml of an aqueous solution containing 21 g of silver nitrate was added to the mixture for 100 seconds. The resulting mixture was stirred for 10 minutes. To the mixture, 0.62 g of N-bromosuccinimide was added. The mixture was left for 10 minutes. The solid contents were filtered off through vacuum filtration. The solid contents were washed with water until the conductivity of the filtrate water was 30 μS per cm. To the obtained solid contents, 150 g of 0.6 wt. % butyl acetate solution of polyvinyl acetate was added. After the mixture was stirred, the mixture was left to cause separation between oily phase and aqueous phase. The aqueous phase containing salts was removed from the mixture to obtain the oily phase. To the oily phase, 80 g of 2.5 wt. % 2-butanone solution of polyvinyl butyral (Denka Butyral #3000-K, Denki Kagaku Kogyo K.K.) was added, and the mixture was stirred. To the resulting mixture, 0.1 mmole of pyridinium perbromide, 0.15 mole of calcium bromide dihydrate and 0.7 g of methanol were added. To the mixture, 200 g of 2-butanone and 59 g of polyvinyl butyral (BUTVAR-76, Monsanto Co.) were added. The mixture was stirred in a homogenizer to obtain an organic silver salt emulsion (average minor size of needle-like grains: 0.04 μm, average major size: 1 μm, distribution coefficient: 30%).

Preparation of Coating Solution of Light-sensitive Layer

To the organic silver salt emulsion, the following components (first addition and second addition) were added while stirring to prepare a coating solution of a light-sensitive layer. The following amounts were based on 1 mole of silver.

| Components of light-sensitive layer (first addition) | |
|---|---|
| Sodium phenylthiosulfonate | 10 mg |
| The following dye | 80 mg |
| 2-Mercapto-5-benzimidazole | 2 g |
| 4-Chlorobenzophenone-2-carboxylic acid | 21.5 g |
| 2-Butanone | 580 g |
| Dimethylformamide | 220 g |

(Dye)

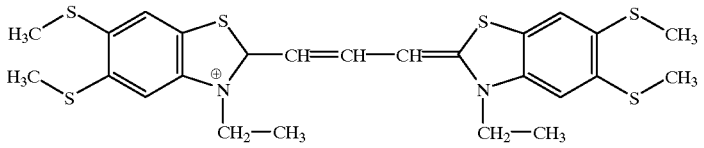

| Components of light-sensitive layer (second addition) | |
|---|---|
| 5-Tribromomethylsuofonyl-2-methylthiazole | 8 g |
| 2-Tribromomethylsulfonylbenzothiazole | 6 g |
| 4,6-Ditrichloromethyl-2-phenyltriazine | 5 g |
| The following disulfide compound | 2 g |
| 1,1-Bis(2-hydroxy-3,5-dimethylphenyl)-3,5,5-trimethylhexane | 155 g |
| Fluorine-containing surface active agent (Megafax F-176P, Dainippon Ink & Chemicals Inc.) | 1.1 g |
| 2-Butanone | 590 g |
| Methyl isobutyl ketone | 10 g |

(Disulfide compound)

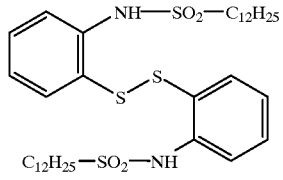

Preparation of Coatina Solution of Emulsion Surface Protective Layer

In 3070 g of 2-butanone and 30 g of ethyl acetate, 75 g of cellulose acetate butyrate (CAB-171-15S, Eastman Chemicals), 5.7 g of 2-methyl phthalate, 1.5 g of tetrachlorophthalic anhydride, 0.3 g of a fluorine-containing surface active agent (Megafax F-176P, Dainippon Ink & Chemicals Inc.), 2 g of spherical silica particles having the average particle size of 3 μm (Sildex H31, Dokai Chemicals) and 6 g of polyisocyanate (Sumidur N3500, Sumitomo Bayer Urethane Co., Ltd.) were dissolved to prepare a coating solution of an emulsion surface protective layer.

Preparation of Coating Solution of Backing Surface Protective Layer

In 500 g of water, 10 g of gelatin, 0.6 g of polymethyl methacrylate particles (average particle size: 7 μm), 0.4 g of sodium dodecylbenzenesulfonate and 0.9 g of a silicone compound (X-22-2809, Shinetsu Silicone Co., Ltd.) were dissolved to prepare a coating solution of a backing surface protective layer.

Preparation of Heat Developable Light-sensitive Material 101

On the emulsion side (on which the antihalation layer was not provided) of the support, the coating solution of the light-sensitive layer was coated (coated silver amount: 2.3 g per $m^2$). On the antihalation layer, the coating solution of the backing surface protective layer was coated (dry thickness: 0.9 μm). On the light-sensitive layer, the coating solution of the emulsion surface protective layer was coated (dry thickness: 2 μm) to prepare a heat developable light-sensitive material 101.

Preparation of Heat Developable Light-Sensitive Materials 102 to 110

Heat developable light-sensitive materials 102 to 109 were prepared in the same manner as in the preparation of the material 101, except that the cyanine dyes (52), (50), (6), (10), (33) and the comparative dyes 1 to 3 were used respectively in place of the cyanine dye (3).

Further, a heat developable light-sensitive material 110 was prepared in the same manner as in the preparation of the material 101, except that the cyanine dye (3) was not used.

Evaluation of Photographic Characteristics

The heat developable light-sensitive materials were exposed to light by using a semiconductor laser sensitometer. The light-sensitive material was heated (developed) at 120° C. for 15 seconds. The obtained image was measured by using a densitometer. The results were evaluated based on he minimum density (Dmin) corresponding to fog and the sensitivity (reciprocal value of the ratio of the exposure for the density of Dmin plus 1.0). The results are set forth in Table 2. In Table 2, the sensitivity means a relative sensitivity wherein the sensitivity of the material is 100.

Evaluation of Sharpness

The heat developable light-sensitive materials were exposed to light by using a semiconductor laser sensitometer. The exposed area had a square shape of 1 $cm^2$. The exposure (x) for the density of 2.5 and the exposure (y) for the density of 0.5 were determined. Further, rectangle areas (width: 100 μm, length: 1 cm) neighboring each other along the length side of the light-sensitive material were exposed to light at the exposures (x) and (y) alternatively. The maximum density and the minimum density within the exposed area were measured by using a microdensitometer. The difference between the maximum density and the minimum density was divided by 2 to evaluate the sharpness. The results are set forth in Table 2.

Evaluation of Storage Stability

The heat developable light-sensitive materials 101 to 110 were stored at a high temperature (50° C.) and a high humidity (relative humidity: 80%) for 3 hours. The absorption at 650 nm was measured before and after storage. The remaining ratio of the dye was determined by the absorption before storage (Db) of the materials 101 to 109, the absorption after storage (Da) of the materials 101 to 109 and the absorption after storage (DO) of the material 110 according to the following formula. There was no change in absorption of the material 110 before and after storage.

$$100\times(Da-D0)/(Db-D0)$$

Where the above-defined value is large (near 100), the dye is excellent in the storage stability. The results are set forth in Table 2.

TABLE 2

| Material | Dye | Minimum density | Sensitivity | Sharpness | Stability |
|---|---|---|---|---|---|
| 101 | (3) | 0.15 | 100 | 0.98 | 95 |
| 102 | (52) | 0.14 | 100 | 0.95 | 93 |
| 103 | (50) | 0.13 | 95 | 0.92 | 82 |
| 104 | (6) | 0.12 | 95 | 0.91 | 35 |
| 105 | (10) | 0.13 | 100 | 0.98 | 100 |
| 106 | (33) | 0.12 | 100 | 0.98 | 100 |
| 107 | CD1 | 0.27 | 95 | 0.97 | 98 |
| 108 | CD2 | 0.65 | 95 | 0.89 | 100 |
| 109 | CD3 | 0.34 | 100 | 0.97 | 97 |
| 110 | None | 0.21 | 95 | 0.42 | — |

(Remark)
CD1: Comparative dye 1 used in Example 2
CD2: Comparative dye 2 used in Example 2
CD3: Comparative dye 3 used in Example 2

What is claimed is:

1. A heat developable light-sensitive material comprising a support, a light-sensitive layer and a non-light-sensitive layer, said light-sensitive layer containing silver halide and a reducing agent, and said non-light-sensitive layer containing a cyanine dye represented by the formula (I-1) or a salt thereof and a base precursor, wherein the cyanine dye or the salt thereof is in the form of solid particles, which are dispersed in the non-light-sensitive layer:

(I-1)

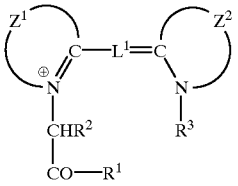

in which $R^1$ is hydrogen, an aliphatic group, an aromatic group, $—NR^{21}R^{24}$, $—OR^{21}$ or $—SR^{21}$, each of $R^{21}$ and $R^{24}$ independently is hydrogen, an aliphatic group or an aromatic group, or $R^{21}$ and $R^{24}$ are combined to form a nitrogen-containing heterocyclic ring; $R^2$ is hydrogen, an aliphatic group or an aromatic group; $R^3$ is an aliphatic group; $L^1$ is a trimethine or a pentamethine; and each of $Z^1$ and $Z^2$ independently is an atomic group forming a five-membered or six-membered nitrogen-containing heterocyclic ring, which may be condensed with an aromatic ring.

2. The heat developable light-sensitive material as claimed in claim 1, wherein $R^1$ in the formula (I-1) is $—NR^{21}R^{24}$, $—OR^{21}$ or $—SR^{21}$.

3. The heat developable light-sensitive material as claimed in claim 1, wherein the cyanine dye is represented by the formula (Ia-1):

(Ia-1)

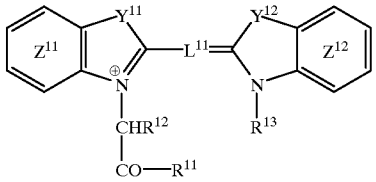

in which $R^{11}$ is hydrogen, an aliphatic group, an aromatic group, $—NR^{31}R^{34}$, $—OR^{31}$ or $—SR^{31}$, each of $R^{31}$ and $R^{34}$ independently is hydrogen, an aliphatic group or an aromatic group, or $R^{31}$ and $R^{34}$ are combined to form a nitrogen-containing heterocyclic ring; $R^{12}$ is hydrogen, an aliphatic group or an aromatic group; $R^{13}$ is an aliphatic group; $L^{11}$ is a trimethine or a pentamethine; each of $Y^{11}$ and $Y^{12}$ independently is $—CR^{14}R^{15}—$, $—NR^{14}—$, —O—, —S— or —Se—, each of $R^{14}$ and $R^{15}$ independently is hydrogen or an aliphatic group or $R^{14}$ and $R^{15}$ are combined to form an aliphatic ring; and the benzene rings of $Z^{11}$ and $Z^{12}$ may be condensed with another benzene ring.

4. The heat developable light-sensitive material as claimed in claim 3, wherein $R^{11}$ in the formula (Ia-1) is $—NR^{31}R^{34}$, $—OR^{31}$ or $—SR^{31}$.

5. The heat developable light-sensitive material as claimed in claim 1, wherein the cyanine dye represented by the formula (I-1) is represented by the formula (Ib):

(Ib)

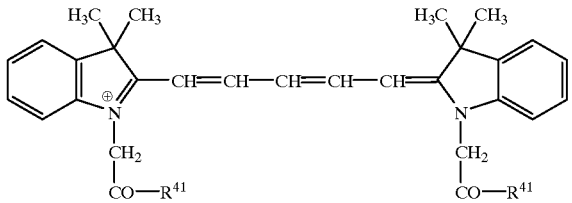

in which the two groups of $R^{41}$ are identical, and $R^{41}$ is hydrogen, an aliphatic group, an aromatic group, $—NR^{51}R^{52}$, $—OR^{51}$ or $—SR^{51}$; each of $R^{51}$ and $R^{52}$ independently is hydrogen, an aliphatic group or an aromatic group, or $R^{51}$ and $R^{52}$ are combined to form a nitrogen-containing heterocyclic ring.

6. A heat development image forming process comprising steps of:

imagewise exposing to light a heat developable light-sensitive material comprising a support, a light-sensitive layer and a non-light-sensitive layer, said light-sensitive layer containing silver halide and a reducing agent, and said non-light-sensitive layer containing a cyanine dye represented by the formula (I-1) or a salt thereof and a base precursor, wherein the cyanine dye or the salt thereof is in the form of solid particles, which are dispersed in the non-light-sensitive layer:

(I-1)

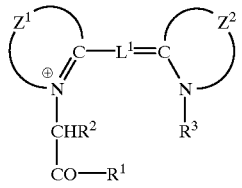

in which $R^1$ is hydrogen, an aliphatic group, an aromatic group, —$NR^{21}R^{24}$, —$OR^{21}$ or —$SR^{21}$, each of $R^{21}$ and $R^{24}$ independently is hydrogen, an aliphatic group or an aromatic group, or $R^{21}$ and $R^{24}$ are combined to form a nitrogen-containing heterocyclic ring; $R^2$ is hydrogen, an aliphatic group or an aromatic group; $R^3$ is an aliphatic group; $L^1$ is a trimethine or a pentamethine; and each of $Z^1$ and $Z^2$ independently is an atomic group forming a five-membered or six-membered nitrogen-containing heterocyclic ring, which may be condensed with an aromatic ring; and then heating the heat developable light-sensitive material at 80 to 200° C. to form a base from the base precursor whereby the cyanine dye is decolored and to develop the silver halide.

7. The heat development image forming process as claimed in claim 6, wherein $R^1$ in the formula (I-1) is —$NR^{21}R^{24}$, —$OR^{21}$ or —$SR^{21}$.

8. The heat development image forming process as claimed in claim 6, wherein the cyanine dye is represented by the formula (Ia-1):

(Ia-1)

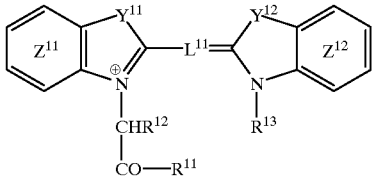

in which $R^{11}$ is hydrogen, an aliphatic group, an aromatic group, —$NR^{31}R^{34}$, —$OR^{31}$ or —$SR^{31}$, each of $R^{31}$ and $R^{34}$ independently is hydrogen, an aliphatic group or an aromatic group, or $R^{31}$ and $R^{34}$ are combined to form a nitrogen-containing heterocyclic ring; $R^{12}$ is hydrogen, an aliphatic group or an aromatic group; $R^{13}$ is an aliphatic group; $L^{11}$ is a trimethine or a pentamethine; each of $Y^{11}$ and $Y^{12}$ independently is —$CR^{14}R^{15}$—, —$NR^{14}$—, —O—, —S— or —Se—, each of $R^{14}$ and $R^{15}$ independently is hydrogen or an aliphatic group or $R^{14}$ and $R^{15}$ are combined to form an aliphatic ring; and the benzene rings of $Z^{11}$ and $Z^{12}$ may be condensed with another benzene ring.

9. The heat development image forming process as claimed in claim 8, wherein $R^{11}$ in the formula (Ia-1) is —$NR^{31}R^{34}$, —$OR^{31}$ or —$SR^{31}$.

10. The heat development image forming process as claimed in claim 6, wherein the cyanine dye represented by the formula (I-1) is represented by the formula (Ib):

(Ib)

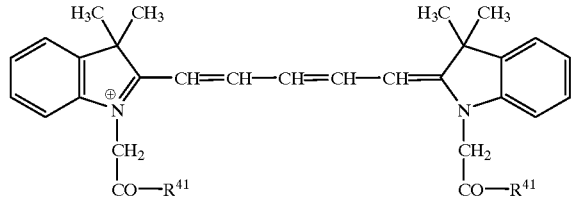

in which the two groups of $R^{41}$ are identical, and $R^{41}$ is hydrogen, an aliphatic group, an aromatic group, —$NR^{51}R^{52}$, —$OR^{51}$ or —$SR^{51}$; each of $R^{51}$ and $R^{52}$ independently is hydrogen, an aliphatic group or an aromatic group, or $R^{51}$ and $R^{52}$ are combined to form a nitrogen-containing heterocyclic ring.

11. A thermal image recording material comprising a support and an image recording layer, said image recording layer containing a cyanine dye represented by the formula (I-1) or a salt thereof and a base precursor, wherein the cyanine dye or the salt thereof is in the form of solid particles, which are dispersed in the image recording layer:

(I-1)

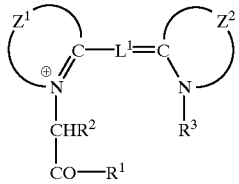

in which $R^1$ is hydrogen, an aliphatic group, an aromatic group, —$NR^{21}R^{24}$, —$OR^{21}$ or —$SR^{21}$, each of $R^{21}$ and $R^{24}$ independently is hydrogen, an aliphatic group or an aromatic group, or $R^{21}$ and $R^{24}$ are combined to form a nitrogen-containing heterocyclic ring; $R^2$ is hydrogen, an aliphatic group or an aromatic group; $R^3$ is an aliphatic group; $L^1$ is a trimethine chain or a pentamethine chain; and each of $Z^1$ and $Z^2$ independently is an atomic group forming a five-membered or six-membered nitrogen-containing heterocyclic ring, which may be condensed with an aromatic ring.

12. The thermal image recording material as claimed in claim 11, wherein the cyanine dye represented by the formula (I-1) is represented by the formula (Ib):

(Ib)

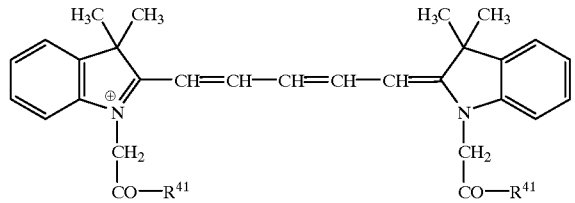

in which the two groups of $R^{41}$ are identical, and $R^{41}$ is hydrogen, an aliphatic group, an aromatic group, —$NR^{51}R^{52}$, —$OR^{51}$ or —$SR^{51}$; each of $R^{51}$ and $R^{52}$ independently is hydrogen, an aliphatic group or an aromatic group, or $R^{51}$ and $R^{52}$ are combined to form a nitrogen-containing heterocyclic ring.

13. A thermally decoloring image recording process comprising imagewise heating a thermal image recording material at 80 to 200° C., said image recording material comprising a support and an image recording layer, said image recording layer containing a cyanine dye represented by the formula (I-1) or a salt thereof and a base precursor, wherein the cyanine dye or the salt thereof is in the form of solid particles, which are dispersed in the image recording layer:

(I-1)

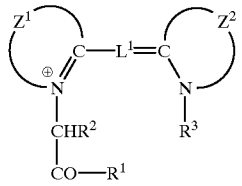

in which $R^1$ is hydrogen, an aliphatic group, an aromatic group, —$NR^{21}R^{24}$, —$OR^{21}$ or —$SR^{21}$, each of $R^{21}$ and $R^{24}$ independently is hydrogen, an aliphatic group or an aromatic group, or $R_{21}$, and $R^{24}$ are combined to form a nitrogen-containing heterocyclic ring; $R^2$ is hydrogen, an aliphatic group or an aromatic group; $R^3$ is an aliphatic group; $L^1$ a trimethine chain or a pentamethine chain; and each of $Z^1$ and $Z^2$ independently is an atomic group forming a five-membered or six-membered nitrogen-containing heterocyclic ring, which may be condensed with an aromatic ring; to form a base from the base precursor whereby the cyanine dye is decolored.

14. The thermally decoloring image recording process as claimed in claim 13, wherein the cyanine dye represented by the formula (I-1) is represented by the formula (Ib):

(Ib)

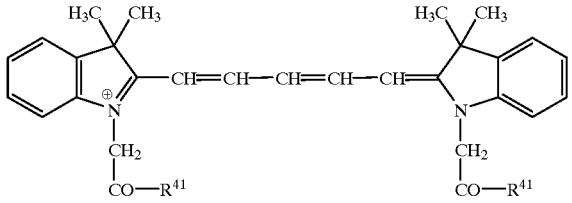

in which the two groups of $R^{41}$ are identical, and $R^{41}$ is hydrogen, an aliphatic group, an aromatic group, —$NR^{51}R^{52}$, —$OR^{51}$ or —$SR^{51}$; each of $R^{51}$ and $R^{52}$ independently is hydrogen, an aliphatic group or an aromatic group, or $R^{51}$ and $R^{52}$ are combined to form a nitrogen-containing heterocyclic ring.

15. A process for decoloring a cyanine dye comprising heating a cyanine dye represented by the formula (II-1) or a salt thereof at 80 to 200° C. in the presence of a base:

(II-1)

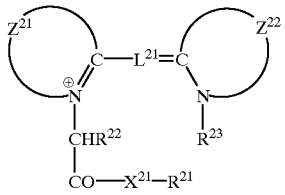

in which $X^{21}$ is —$NR^{24}$—, —O— or —S—; each of $R^{21}$ and $R^{24}$ independently is hydrogen, an aliphatic group or an aromatic group, or $R^{21}$ and $R^{24}$ are combined to form a nitrogen-containing heterocyclic ring; $R^{22}$ is hydrogen, an aliphatic group or an aromatic group; $R^{23}$ is an aliphatic group; $L^{21}$ is a trimethine chain or a pentamethine chain; and each of $Z^{21}$ and $Z^{22}$ independently is an atomic group forming a five-membered or six-membered nitrogen-containing heterocyclic ring, which may be condensed with an aromatic ring.

16. The process for decoloring a cyanine dye as claimed in claim 15, wherein the cyanine dye represented by the formula (II-1) is represented by the formula (IIa-1):

(IIa-1)

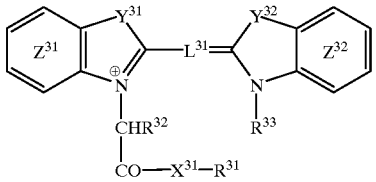

in which $X^{31}$ is —$NR^{34}$—, —O— or —S—; each of $R^{31}$ and $R^{34}$ independently is hydrogen, an aliphatic group or an aromatic group, or $R^{31}$ and $R^{34}$ are combined to form a nitrogen-containing heterocyclic ring; $R^{32}$ is hydrogen, an aliphatic group or an aromatic group; $R^{33}$ is an aliphatic group; $L^{31}$ is a trimethine chain or a pentamethine chain; $Y^{31}$ and $Y^{32}$ independently is —$CR^{37}R^{38}$—, —$NR^{37}$—, —O—, —S— or —Se—, each of $R^{37}$ and $R^{38}$ independently is hydrogen or an aliphatic group or $R^{37}$ and $R^{38}$ are combined to form an aliphatic ring; and the benzene rings of $Z^{31}$ and $Z^{32}$ may be condensed with another benzene ring.

* * * * *